US005799665A

United States Patent [19]

Cho et al.

[11] Patent Number: 5,799,665

[45] Date of Patent: *Sep. 1, 1998

[54] PROCESS AND APPARATUS FOR IMPREGNATION AND EXPANSION OF TOBACCO

[76] Inventors: Kwang H. Cho, 2141 Carbon Hill Dr., Midlothian, Va. 23113; Thomas J. Clarke, 1726 Westhill Rd., Richmond, Va. 23226; Joseph M. Dobbs, 4538 E. Seminary Ave., Richmond, Va. 23227; Eugene B. Fischer, 12800 Nightingale Dr., Chester, Va. 23831; Diane L. Leister, 4200 Carafe Dr., Richmond, Va. 23234; Jose M. G. Nepomuceno, Rt. 2 Box 163D4, Beaverdam, Va. 23015; Walter A. Nichols, 3508 Quail Hill Court, Midlothian, Va. 23112; Ravi Prasad, 10821 Hinshaw Dr., Midlothian, Va. 23113

[ * ] Notice: The term of this patent shall not extend beyond the expiration date of Pat. No. 5,649,552.

[21] Appl. No.: 769,972

[22] Filed: Dec. 19, 1996

Related U.S. Application Data

[63] Continuation of Ser. No. 484,366, Jun. 7, 1995, Pat. No. 5,649,552, which is a continuation of Ser. No. 992,446, Dec. 17, 1992, abandoned, and a continuation-in-part of Ser. No. 717,064, Jun. 18, 1991, Pat. No. 5,251,649.

[51] Int. Cl.[6] ..... A24B 3/18

[52] U.S. Cl. ..... 131/291; 131/296

[58] Field of Search ..... 131/296, 291, 131/292, 900

[56] References Cited

U.S. PATENT DOCUMENTS

| | | | |
|---|---|---|---|
| Re. 32,013 | 10/1985 | de la Burde et al. | 131/291 |
| Re. 32,014 | 10/1985 | Sykes et al. | 131/291 |
| 1,789,435 | 1/1931 | Hawkins | 131/271 |
| 1,924,827 | 8/1933 | Anderson | 131/291 |
| 2,344,106 | 3/1944 | Reed | 131/136 |
| 3,771,533 | 11/1973 | Armstrong et al. | 131/140 |
| 4,235,250 | 11/1980 | Utsch | 131/140 |

(List continued on next page.)

FOREIGN PATENT DOCUMENTS

| | | | |
|---|---|---|---|
| 0328676 | 8/1989 | European Pat. Off. | A24B 3/18 |
| 0424778 | 5/1991 | European Pat. Off. | A24B 3/18 |
| 0450569 | 10/1991 | European Pat. Off. | A24B 3/18 |
| 0484899 | 5/1992 | European Pat. Off. | A24B 3/18 |
| 64-80272 | 3/1989 | Japan | A24B 3/18 |
| 1484536 | 9/1977 | United Kingdom . | |
| 2115677 | 9/1983 | United Kingdom | A24B 3/18 |
| WO 90/06695 | 6/1990 | WIPO | A24B 3/18 |

OTHER PUBLICATIONS

Waltz, Dr. Peter, "With The INCOM Systems", Reemtsma Tobacco Products & Technology, Jun. 6–10, 1983, Délémont, Switzerland.

"With The INCOM System," Reemtsma Tobacco Products & Technology.

*Primary Examiner*—Aaron J. Lewis
*Assistant Examiner*—Charles W. Anderson
*Attorney, Agent, or Firm*—Charles E. B. Glenn; James E. Schardt; James T. Moore

[57] ABSTRACT

A process for expanding tobacco is provided which employs carbon dioxide gas. Tobacco temperature and OV content are adjusted prior to contacting the tobacco with carbon dioxide gas. The disclosed process is suitable for impregnating and expanding tobacco having a high bulk density. In order to achieve a high bulk density, the tobacco may be compacted or compressed to achieve an increased and more uniform bulk density prior to its impregnation with carbon dioxide. The process may be carried out with a short cycle impregnation in an apparatus according to the invention. A thermodynamic path is followed during impregnation which allows a controlled amount of the carbon dioxide gas to condense on the tobacco. This liquid carbon dioxide evaporates during depressurization helping to cool the tobacco bed uniformly. After impregnation, the tobacco may be expanded immediately or kept at or below its post-vent temperature in a dry atmosphere for subsequent expansion.

22 Claims, 22 Drawing Sheets

U.S. PATENT DOCUMENTS

| | | | |
|---|---|---|---|
| 4,250,898 | 2/1981 | Utsch et al. | 131/140 |
| 4,253,474 | 3/1981 | Hibbitts et al. | 131/140 |
| 4,258,729 | 3/1981 | de la Burde et al. | 131/140 |
| 4,289,148 | 9/1981 | Ziehn | 131/291 |
| 4,310,006 | 1/1982 | Hibbitts et al. | 131/290 |
| 4,333,483 | 6/1982 | de la Burde et al. | 131/352 |
| 4,336,814 | 6/1982 | Sykes et al. | 131/291 |
| 4,340,073 | 7/1982 | de la Burde et al. | 131/291 |
| 4,366,825 | 1/1983 | Utsch et al. | 131/296 |
| 4,460,000 | 7/1984 | Steinberg | 131/296 |
| 4,461,310 | 7/1984 | Ziehn | 131/296 |
| 4,519,407 | 5/1985 | Hellier . | |
| 4,523,598 | 6/1985 | Weiss et al. | 131/291 |
| 4,528,994 | 7/1985 | Korte et al. | 131/296 |
| 4,528,995 | 7/1985 | Korte et al. | 131/304 |
| 4,561,452 | 12/1985 | Gahrs | 131/297 |
| 4,577,646 | 3/1986 | Ziehn | 131/296 |
| 4,630,619 | 12/1986 | Korte et al. | 131/296 |
| 4,697,604 | 10/1987 | Brown et al. | 131/296 |
| 4,727,889 | 3/1988 | Niven, Jr. et al. | 131/297 |
| 4,760,854 | 8/1988 | Jewell et al. | 131/291 |
| 4,791,942 | 12/1988 | Rickett et al. | 131/291 |
| 4,898,188 | 2/1990 | Niven, Jr. et al. | 131/296 |
| 4,946,697 | 8/1990 | Payne | 426/445 |
| 5,012,826 | 5/1991 | Kramer | 131/291 |
| 5,020,550 | 6/1991 | Uchiyama et al. | 131/296 |
| 5,065,774 | 11/1991 | Grubbs et al. | 131/291 |
| 5,076,293 | 12/1991 | Kramer | 131/291 |
| 5,251,649 | 10/1993 | Cho et al. | 131/296 |
| 5,649,552 | 7/1997 | Cho et al. | 131/291 |

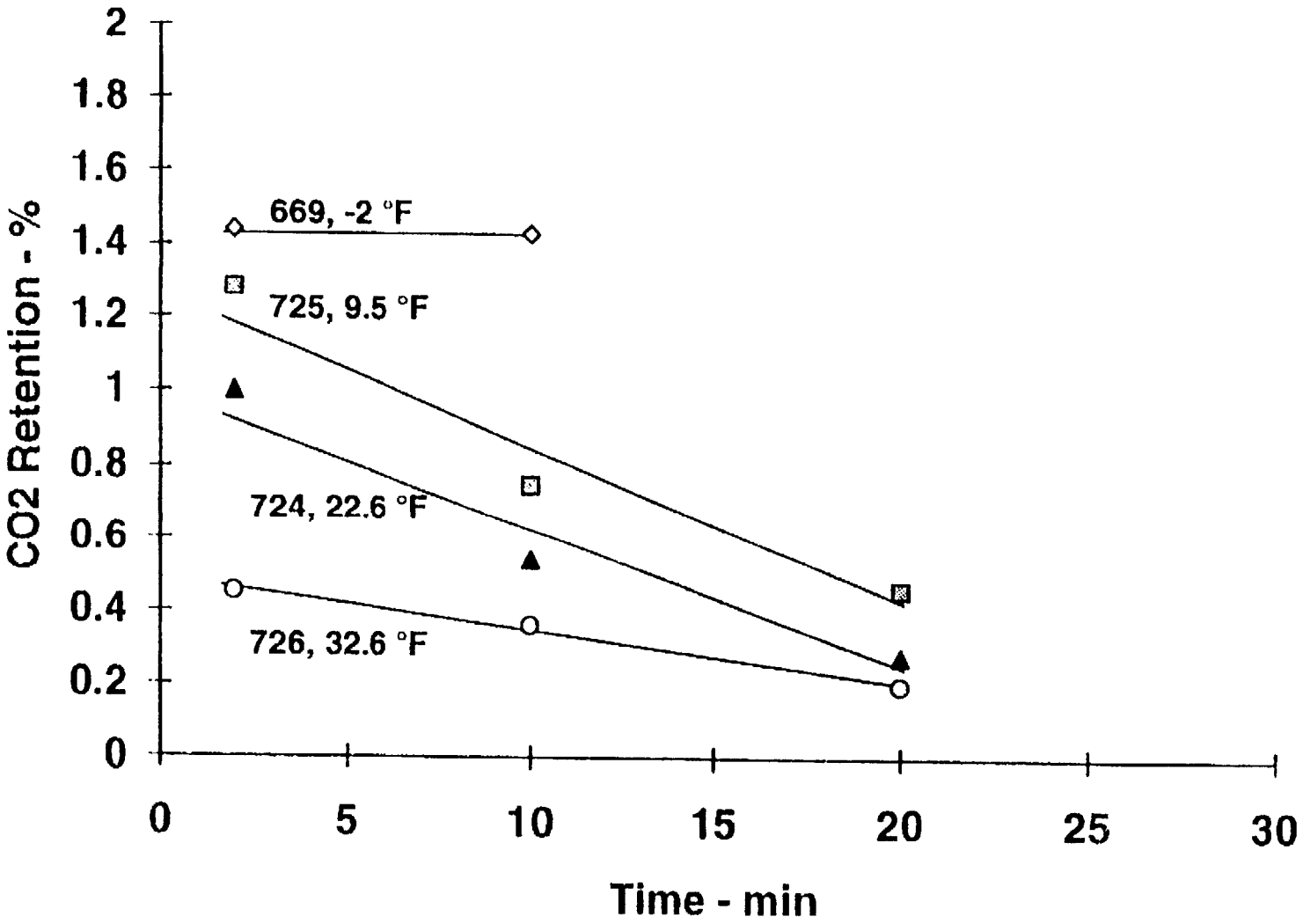
FIG. 21 (All-Gas Process)

PROCESS AND APPARATUS FOR IMPREGNATION AND EXPANSION OF TOBACCO

This application is a continuation of Ser. No. 08/484,366 filed Jun. 7, 1995, now U.S. Pat. No. 5,649,553 which is a continuation of Ser. No. 07/992,446 filed Dec. 17, 1992, now abandoned, and is a continuation-in-part of Ser. No. 07/717,064, filed Jun. 18, 1991, which issued Oct. 12, 1993, as U.S. Pat. No. 5,251,649.

BACKGROUND OF THE INVENTION

This invention relates to a process for expanding the volume of tobacco and an apparatus for carrying out the process. More particularly, this invention relates to expanding tobacco using carbon dioxide.

The tobacco art has long recognized the desirability of expanding tobacco to increase the bulk or volume of tobacco. There have been various reasons for expanding tobacco. One of the early purposes for expanding tobacco involved making up the loss of weight caused by the tobacco curing process. Another purpose was to improve the smoking characteristics of particular tobacco components, such as tobacco stems. It has also been desired to increase the filling power of tobacco so that a smaller amount of tobacco would be required to produce a smoking product, such as a cigarette, which would have the same firmness and yet would deliver lower tar and nicotine than a comparable smoking product made of non-expanded tobacco having a more dense tobacco filler.

Various methods have been proposed for expanding tobacco, including the impregnation of tobacco with a gas under pressure and the subsequent release of pressure, whereby the gas causes expansion of the tobacco cells to increase the volume of the treated tobacco. Other methods which have been employed or suggested have included the treatment of tobacco with various liquids, such as water or relatively volatile organic or inorganic liquids, to impregnate the tobacco with the same, after which the liquids are driven off to expand the tobacco. Additional methods which have been suggested have included the treatment of tobacco with solid materials which, when heated, decompose to produce gases which serve to expand the tobacco. Other methods include the treatment of tobacco with gas-containing liquids, such as carbon dioxide-containing water, under pressure to incorporate the gas in the tobacco and when the impregnated tobacco is heated or the ambient pressure reduced the tobacco expands. Additional techniques have been developed for expanding tobacco which involve the treatment of tobacco with gases which react to form solid chemical reaction products within the tobacco, which solid reaction products may then decompose by heat to produce gases within the tobacco which cause expansion of tobacco upon their release. More specifically:

U.S. Pat. No. 1,789,435 describes a method and apparatus for expanding the volume of tobacco,in order to make up the loss of volume caused in curing tobacco leaf. To accomplish this object, the cured and conditioned tobacco is contacted with a gas, which may be air, carbon dioxide or steam under pressure and the pressure is then relieved, the tobacco tends to expand. The patent states that the volume of the tobacco may, by that process, be increased to the extent of about 5–15%.

U.S. Pat. No. 3,771,533, commonly assigned herewith, involves a treatment of tobacco with carbon dioxide and ammonia gases, whereby the tobacco is saturated with these gases and ammonium carbamate is formed in situ. The ammonium carbamate is thereafter decomposed by heat to release the gases within the tobacco cells and to cause expansion of the tobacco.

U.S. Pat. No. 4,258,729, commonly assigned herewith, describes a method for expanding the volume of tobacco in which the tobacco is impregnated with gaseous carbon dioxide under conditions such that the carbon dioxide remains substantially in the gaseous state. Pre-cooling the tobacco prior to the impregnation step or cooling the tobacco bed by external means during impregnation is limited to avoid condensing the carbon dioxide to any significant degree.

U.S. Pat. No. 4,235,250, commonly assigned herewith, describes a method for expanding the volume of tobacco in which the tobacco is impregnated with gaseous carbon dioxide under conditions such that the carbon dioxide remains substantially in the gaseous state. During depressurization some of the carbon dioxide is converted to a partially condensed state within the tobacco. That patent teaches that the carbon dioxide enthalpy is controlled in such a manner to minimize carbon dioxide condensation.

U.S. Pat. No. Re. 32,013, commonly assigned herewith, describes a method and apparatus for expanding the volume of tobacco in which the tobacco is impregnated with liquid carbon dioxide, converting the liquid carbon dioxide to solid carbon dioxide in situ, and then causing the solid carbon dioxide to vaporize and expand the tobacco.

Copending and commonly-assigned U.S. patent application Ser. No. 07/717,064, filed Jun. 18, 1991, discloses a process for impregnating tobacco with carbon dioxide and then expanding the tobacco. That disclosed process includes steps of contacting tobacco with gaseous carbon dioxide and controlling process conditions to cause a controlled amount of carbon dioxide to condense on the tobacco.

It has been found that with gaseous carbon dioxide impregnation processes, the tobacco must achieve a sufficiently low exit temperature at the end of the process (after the venting of carbon dioxide from maximum pressure) in order for the tobacco to be successfully impregnated. During venting, the escaping carbon dioxide lowers the temperature of the tobacco bed.

Prior processes for impregnating tobacco using gaseous carbon dioxide without controlled condensation cannot achieve sufficient cooling of a high bulk density tobacco bed because cooling is provided only by gas expansion. As the bulk density of the tobacco bed increases, the mass of tobacco to be cooled increases and the volume or void space remaining within the tobacco bed and the available gas for cooling decreases. Without sufficient cooling, an acceptable pre-expansion stability of the impregnated tobacco cannot be achieved.

Typically, a loosely filled tobacco bed, exhibits a tobacco bulk density gradient with a higher bulk density toward the bottom due to the compressing effect of the weight of the column of tobacco. Tobacco expansion processes using gaseous carbon dioxide and loosely filled tobacco beds of relatively low bulk density may result in non-uniform cooling of the tobacco and thus non-uniform stability and expansion of the tobacco.

The bulk density at the bottom of a deep tobacco bed may be the limiting factor in a gas-only process, because the tobacco at the bottom of a deep bed may have too great a bulk density to be efficiently cooled by gas expansion cooling. As a result, tobacco expansion processes using gaseous carbon dioxide are limited to relatively small or shallow tobacco beds. While such small beds have been used for experimental development, they were not usually commercially practical.

SUMMARY OF THE INVENTION

The present process employing saturated carbon dioxide gas in combination with a controlled amount of liquid carbon dioxide, as described below, has been found to overcome the disadvantages of the prior art processes and provides an improved method for expanding tobacco. The moisture content of the tobacco to be expanded is carefully controlled prior to contact with the saturated carbon dioxide gas. The temperature of the tobacco is carefully controlled throughout the impregnation process. Saturated carbon dioxide gas is allowed to thoroughly impregnate the tobacco, preferably under conditions such that a controlled amount of the carbon dioxide condenses on the tobacco. After the impregnation has been completed, the elevated pressure is reduced, thereby cooling the tobacco to the desired exit temperature. Cooling of the tobacco is due to both the expansion of the carbon dioxide gas and the evaporation of the condensed liquid carbon dioxide from the tobacco. The resulting carbon dioxide-containing tobacco is then subjected to conditions of temperature and pressure, preferably rapid heating at atmospheric pressure, which result in the expansion of the carbon dioxide impregnant and the consequent expansion of the tobacco to provide a tobacco of lower density and increased volume.

Tobacco impregnated according to the present invention may be expanded using less energy, e.g., a significantly lower temperature gas stream may be used at a comparable residence time, than tobacco impregnated under conditions where liquid carbon dioxide is used.

In addition, the present invention affords greater control of the chemical and flavor components, e.g., reducing sugars and alkaloids, in the final tobacco product by allowing expansion to be carried out over a greater temperature range than was practical in the past.

Furthermore, impregnating and expanding tobacco according to the present invention can achieve a greater process throughput than processes using gaseous carbon dioxide under conditions that do not result in condensation of the carbon dioxide prior to venting. According to the present invention, evaporation of condensed carbon dioxide provides sufficient cooling so that even tobacco of a substantially high bulk density may be effectively impregnated and expanded. This evaporation cooling is preferable in high bulk density tobacco beds for achieving a sufficiently low post-vent tobacco temperature to ensure stability of the impregnated tobacco.

It has been found that when practicing the present invention the post-vent tobacco temperature is essentially independent of tobacco bulk density. The process of the invention is effective for impregnating tobacco that has a high bulk density for any reason, e.g., due to prior processing steps, or due to naturally increased bulk densities at the bottom of large beds of tobacco. The invention is applicable to both large and small batch operation.

In order to provide a tobacco bed having both a desirably high (or elevated) bulk density and a more uniform density throughout the bed, the tobacco may be compressed or compacted before it is impregnated with carbon dioxide gas. Thereby, in addition to further ensuring uniformity of carbon dioxide impregnation, the mass throughput of the process may be increased.

The process throughput may also be increased by loading the impregnator to higher tobacco bulk densities in accordance with one of the preferred embodiments of the present invention. Also, the compacted tobacco bed is less likely than a loose tobacco bed to settle due to gravity or gas flow which may otherwise create an undesireable void space in the impregnator. Additionally, less heat of compression develops because a smaller volume of gas is compressed per pound of tobacco. The condensed carbon dioxide on the tobacco at the latter stages of pressurization avoids the localization of heat of compression. Because of the sufficiently low post-vent temperatures achieved, the process of the invention achieves acceptable carbon dioxide retention and stability after impregnation even with a high bulk density of tobacco.

The increased process throughput due to increased mass throughput achieves greater cost economy in production, or allows capital cost savings by reducing the size of the process equipment. Furthermore, a small-batch, short-cycle process operates as an essentially continuous process carried out in a preferred apparatus as described below.

The reduced quantity of carbon dioxide gas required with elevated bulk densities also achieves environmental benefits, because less gas is vented to the atmosphere per pound of tobacco.

BRIEF DESCRIPTION OF THE DRAWINGS

The above and other objects and advantages of the invention will be apparent upon consideration of the following detailed description and representative examples, taken in conjunction with the accompanying drawings, in which like run designations refer to like runs throughout, and in which:

FIG. 21 is a plot of carbon dioxide retention versus time for different bulk densities and post-vent temperatures.

Detailed Description Of The Invention

Figure 1:
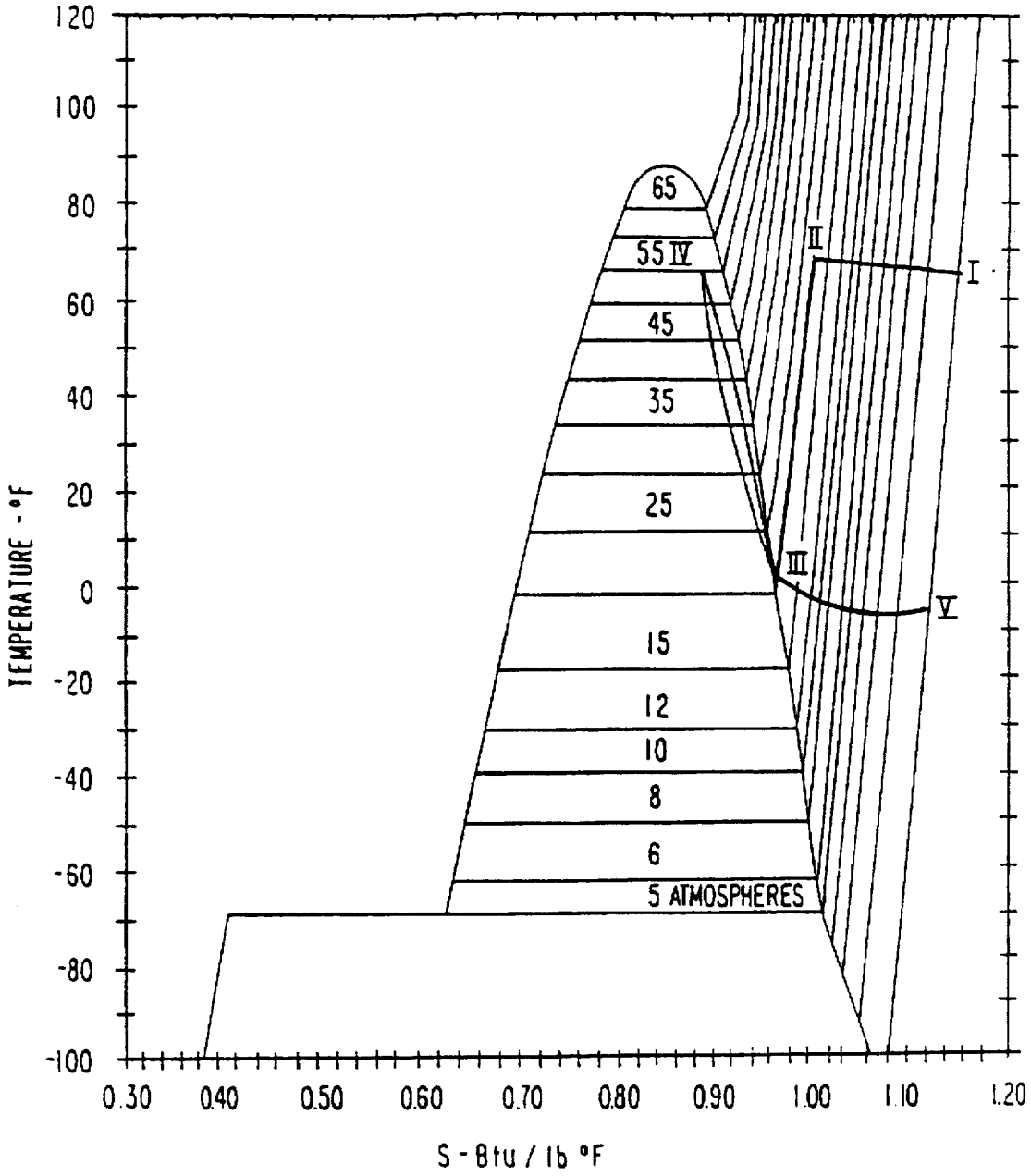
FIG. 1 is a standard temperature-entropy diagram for carbon dioxide.

The present invention relates broadly to a process for expanding tobacco employing a readily available, relatively inexpensive, non-combustible and non-toxic expansion agent. More particularly, the present invention relates to the production of an expanded tobacco product of substantially reduced density and increased filling power, produced by impregnating tobacco under pressure with saturated gaseous carbon dioxide and a controlled amount of condensed liquid carbon dioxide, rapidly releasing the pressure, and then causing the tobacco to expand. Expansion may be accomplished by subjecting the impregnated tobacco to heat, radiant energy or similar energy generating conditions which will cause the carbon dioxide impregnant to rapidly expand.

To carry out the process of the present invention, one may treat either whole cured tobacco leaf, tobacco in cut or chopped form, or selected parts of tobacco such as tobacco stems or possibly even reconstituted tobacco. In comminuted form, the tobacco to be impregnated preferably has a particle size of from about 6 mesh to about 100 mesh, more preferably the tobacco has a particle size not less than about 30 mesh. As used herein, mesh refers to United States standard sieve and those values reflect the ability of more than 95% of the particles of a given size to pass through a screen of a given mesh value.

As used herein, % moisture may be considered equivalent to oven-volatiles content (OV) since not more than about 0.9% of tobacco weight is volatiles other than water. Oven volatiles determination is a simple measurement of tobacco weight loss after exposure for 3 hours in a circulating air oven controlled at 212° F. The weight loss as a percentage of initial weight is oven-volatiles content.

Generally, the tobacco to be treated will have an OV content of at least about 12% and less than about 21%, although tobacco having a higher or lower OV content may be successfully impregnated according to the present invention. Preferably, the tobacco to be treated will have an OV content of about 13% to about 15%. Below about 12% OV, tobacco is too easily broken, resulting in a large amount of tobacco fines. Above about 21% OV, excessive amounts of pre-cooling are needed to achieve acceptable stability and a very low post-vent temperature is required, resulting in a brittle tobacco which is easily broken.

The tobacco to be expanded will generally be placed in a pressure vessel in such a manner that it can be suitably contacted by carbon dioxide. For example, a wire mesh belt or platform may be used to support the tobacco in the vessel.

In a further improvement according to the present invention, tobacco with a high bulk density may be processed. In order to achieve a desireable high bulk density or a more uniform density throughout the tobacco bed, or both a high bulk density and a more uniform tobacco bed, the tobacco may be compacted or compressed before it is impregnated with carbon dioxide. The tobacco may be compacted before it is placed in the pressure vessel, within the pressure vessel or both, so that the resultant bulk density of the tobacco in the pressure vessel is essentially uniform and substantially greater than the bulk density of a typical loose fill tobacco.

For a batch impregnation process, the tobacco-containing pressure vessel is preferably purged with carbon dioxide gas, the purging operation generally taking from about 1 minute to about 4 minutes. In the preferred embodiment involving a high bulk density bed of tobacco, purge requirements may be reduced because void space may be minimized and because the vessel may be smaller per pound of tobacco. The example described in detail below with reference to FIGS. 14–16 operates with only a 5 second purge step. The purging step may be eliminated without detriment to the final product. The benefits of purging are the removal of gases that may interfere with carbon dioxide recovery and the removal of foreign gases that may interfere with full penetration of the carbon dioxide.

The gaseous carbon dioxide which is employed in the process of this invention will generally be obtained from a supply tank where it is maintained in saturated liquid form at a pressure of from about 400 psig to about 1050 psig. The supply tank may be fed with recompressed gaseous carbon dioxide vented from the pressure vessel. Additional carbon dioxide may be obtained from a storage vessel where it is maintained in liquid form generally at a pressure of from about 215 psig to about 305 psig and temperatures of from about −20° F. to about 0° F. The liquid carbon dioxide from the storage vessel may be mixed with the recompressed gaseous carbon dioxide and stored in the supply tank. Alternatively, liquid carbon dioxide from the storage vessel may be preheated, for example, by suitable heating coils around the feed line, to a temperature of about 0° F. to about 84° F. and a pressure of about 300 psig to about 1000 psig before being introduced into the pressure vessel. After the carbon dioxide is introduced into the pressure vessel, the interior of the vessel, including the tobacco to be treated, will generally be at a temperature of from about 20° F. to about 80° F. and a pressure sufficient to maintain the carbon dioxide gas at or substantially at a saturated state.

Tobacco stability, i.e., the length of time the impregnated tobacco may be stored after depressurization before the final expansion step and still be satisfactorily expanded, is dependent on the initial tobacco OV content, i.e., pre-impregnation OV content, and the tobacco temperature after venting of the pressure vessel. Tobacco with a higher initial OV content requires a lower tobacco post-vent temperature than tobacco with a lower initial OV content to achieve the same degree of stability.

The effect of OV content on the stability of tobacco impregnated with carbon dioxide gas at 250 psia and −18°

C. was determined by placing a weighed sample of bright tobacco, typically about 60 g to about 70 g, in a 300 cc pressure vessel. The vessel was then immersed in a temperature controlled bath set at −18° C. After the vessel reached thermal equilibrium with the bath, the vessel was purged with carbon dioxide gas. The vessel was then pressured to about 250 psia. Gas phase impregnation was assured by maintaining the carbon dioxide pressure at least 20 psi to 30 psi below the carbon dioxide saturation pressure at −18° C. After allowing the tobacco to soak at pressure for about 15 minutes to about 60 minutes the vessel pressure was rapidly decreased to atmospheric pressure in about 3 seconds to about 4 seconds by venting to atmosphere. The vent valve was immediately closed and the tobacco remained in the pressure vessel immersed in the temperature controlled bath at −18° C. for about 1 hour. After about 1 hour, the vessel temperature was increased to about 25° C. over about two hours in order to liberate the carbon dioxide remaining in the tobacco. The vessel pressure and temperature were continually monitored using an IBM compatible computer with LABTECH version 4 data acquisition software from Laboratories Technologies Corp. The amount of carbon dioxide evolved by the tobacco over time at a constant temperature, can be calculated based on the vessel pressure over time.

Figure 3:
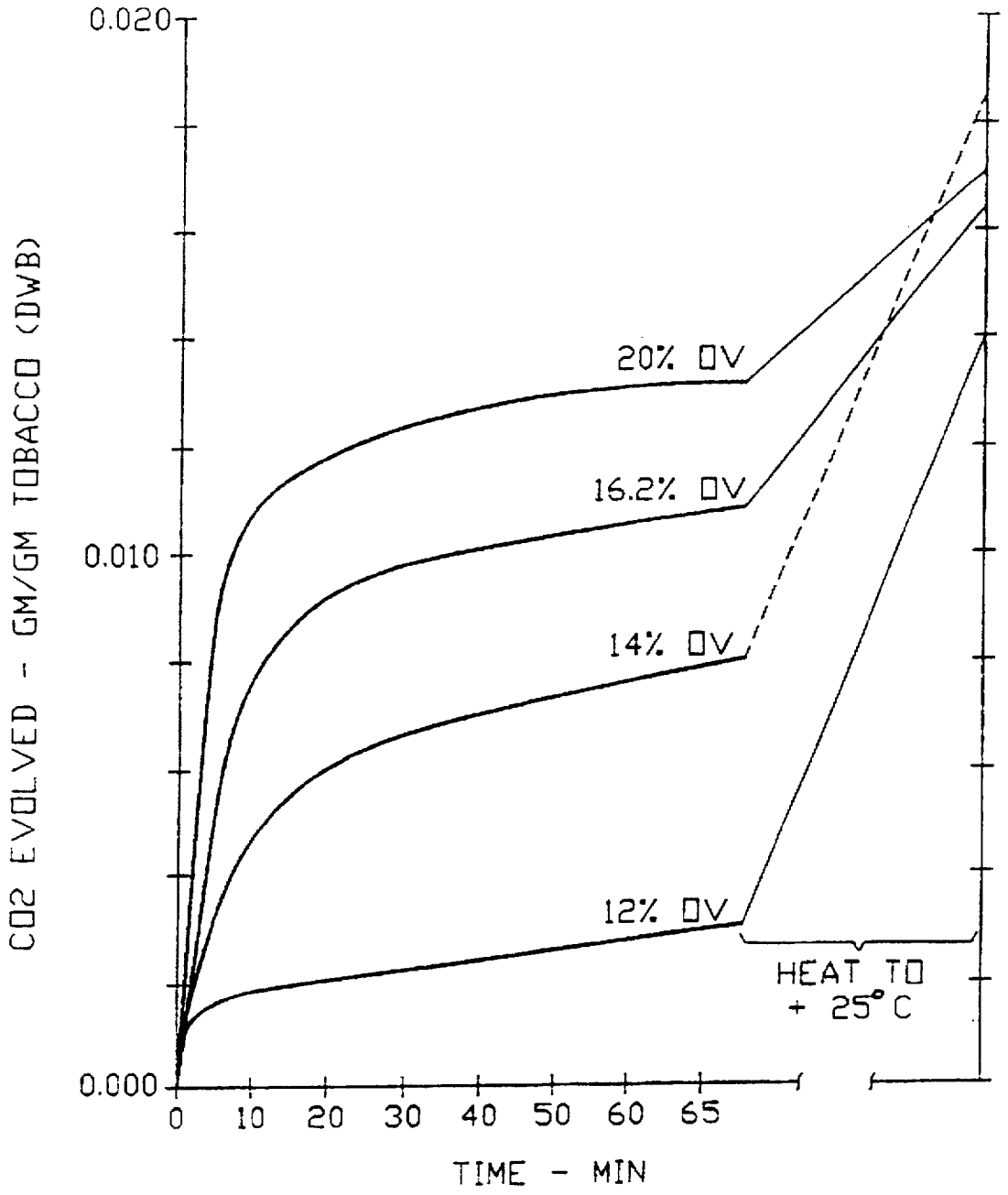
FIG. 3 is a plot of weight percent carbon dioxide evolved from tobacco impregnated at 250 psia and −18° C. versus post-impregnation time for tobacco with an OV content of about 12%, 14%, 16.2%, and 20%.

FIG. 3 compares the stability of about 12%, 14%, 16.2% and 20% OV bright tobacco impregnated with carbon dioxide gas at 250 psia at −18° C. as described above. Tobacco with an OV content of about 20% lost about 71% of its carbon dioxide pickup after 15 minutes at −18° C., while tobacco with an OV content of about 12% lost only about 25% of its carbon dioxide pickup after 60 minutes. The total amount of carbon dioxide evolved after increasing the vessel temperature to 25° C. is an indication of the total carbon dioxide pickup. This data indicates that, for impregnations at comparable pressures and temperatures, as tobacco OV content increases, tobacco stability decreases.

Figure 4:
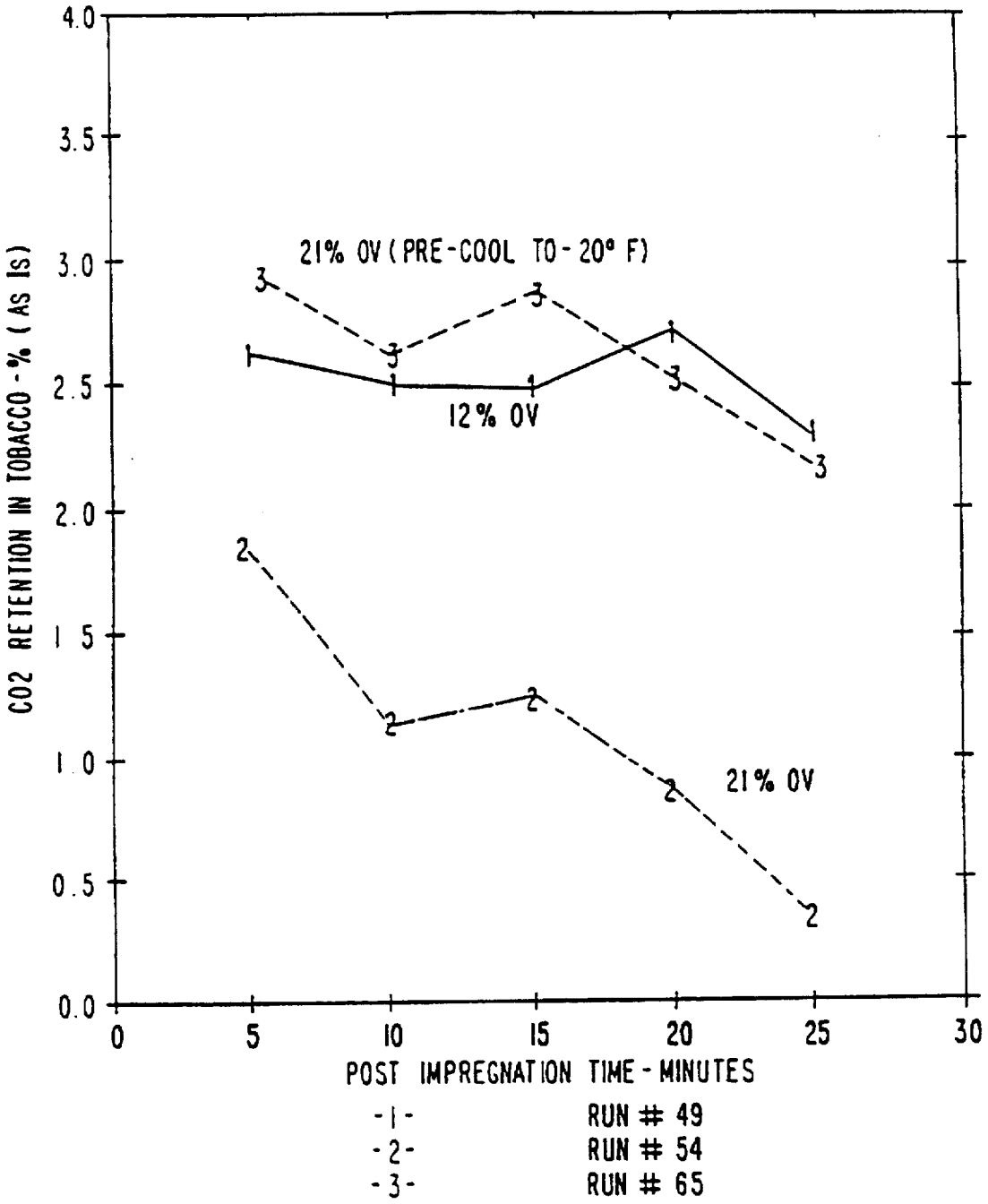
FIG. 4 is a plot of weight percent carbon dioxide retained in the tobacco versus post-vent time for three different OV tobaccos.
Figure 5:
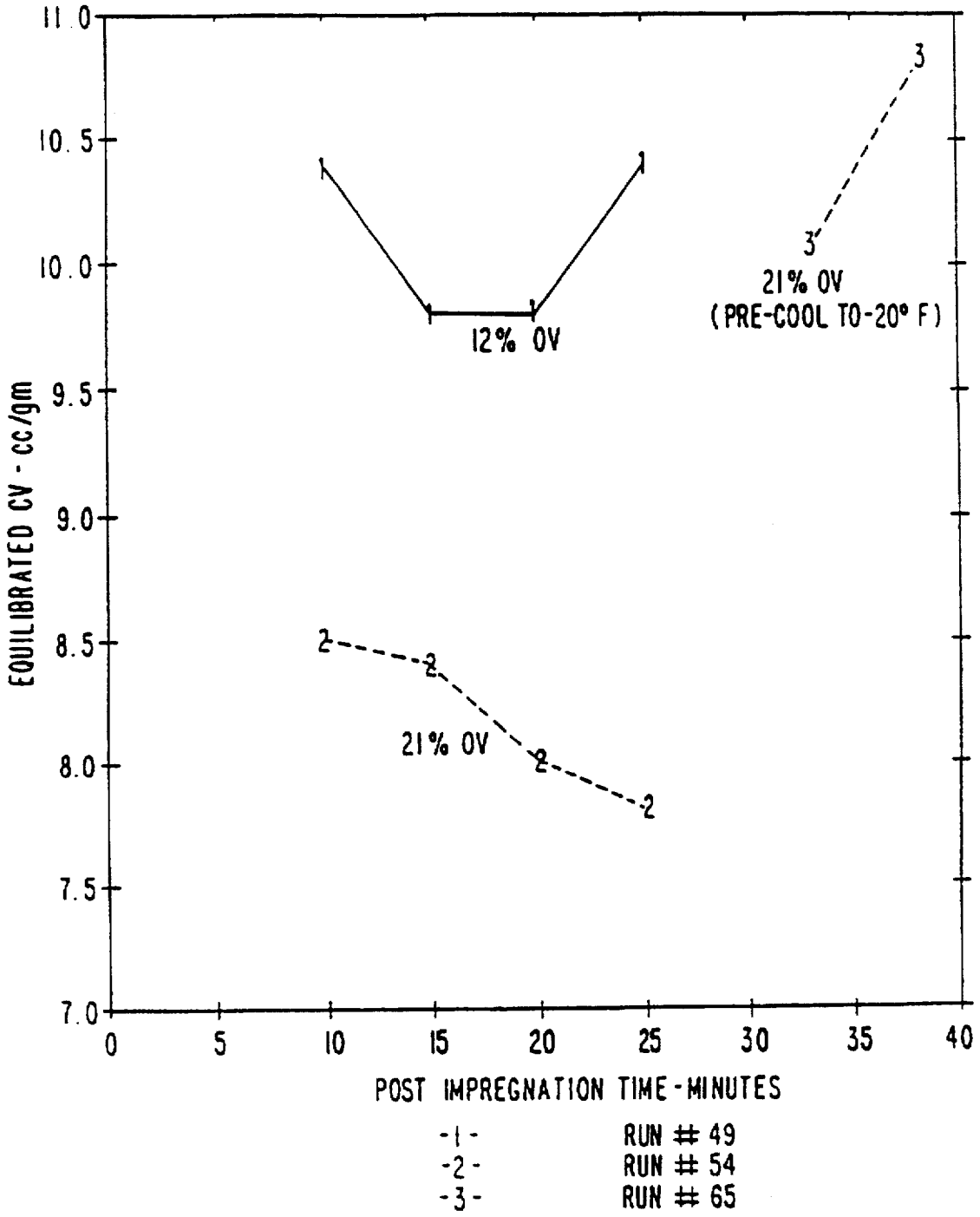
FIG. 5 is a plot of expanded tobacco equilibrium CV versus hold-time before expansion for tobacco with an OV content of about 12% and about 21%.
Figure 6:
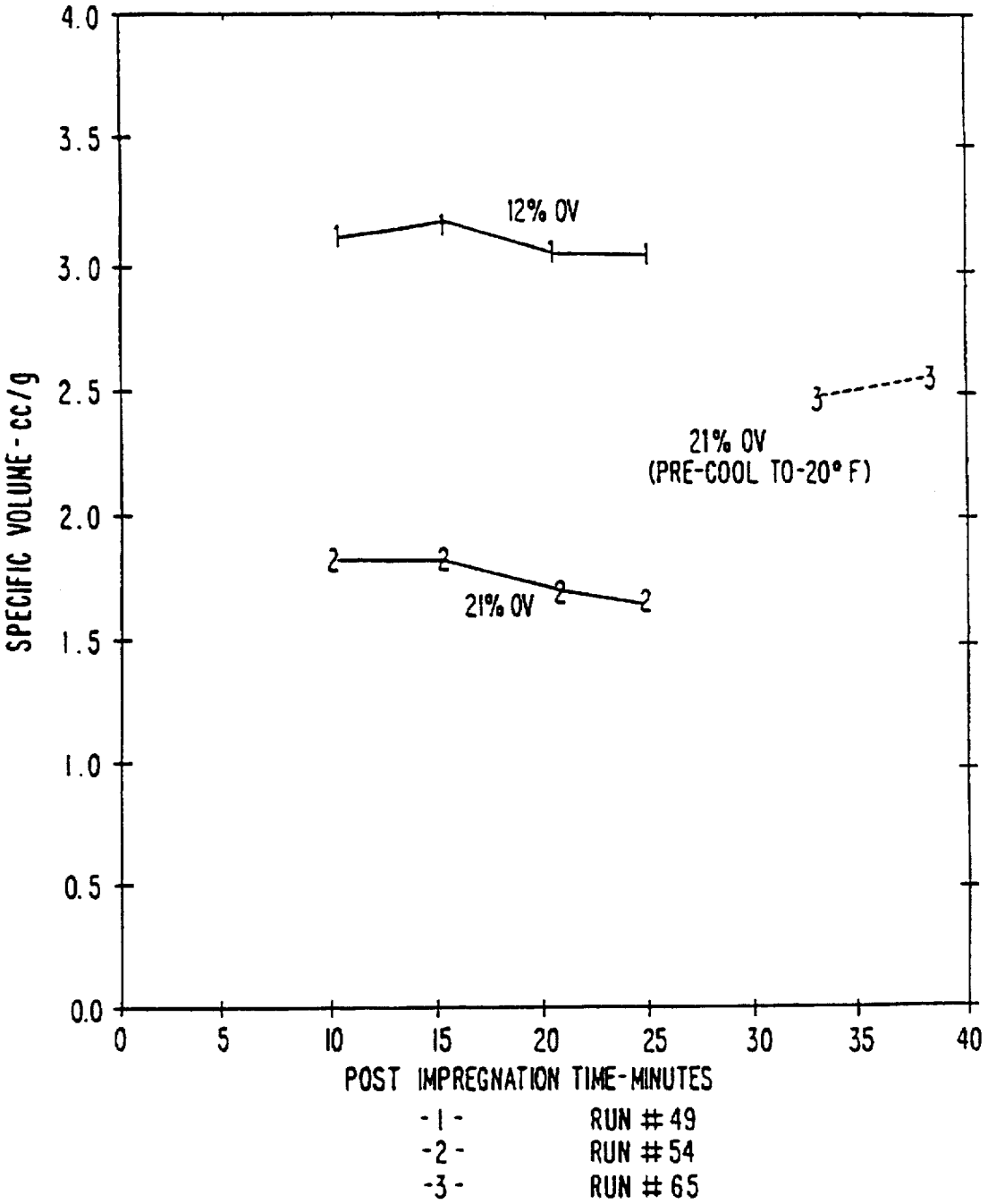
FIG. 6 is a plot of expanded tobacco specific volume versus hold-time before expansion for tobacco with an OV content of about 12% and about 21%.

In order to achieve sufficient tobacco stability, it is preferred that the tobacco temperature be approximately about 0° F. to about 10° F. after venting of the pressure vessel when the tobacco to be expanded has an initial OV content of about 15%. Tobacco with an initial OV content greater than about 15% should have a post-vent temperature lower than about 0° F. to about 10° F. and tobacco with an initial OV content less than 15% may be maintained at a temperature greater than about 0° F. to about 10° F. in order to achieve a comparable degree of stability. For example, FIG. 4 illustrates the effect of tobacco post-vent temperature on tobacco stability at various OV contents. FIG. 4 shows that tobacco with a higher OV content, about 21%, requires a lower post-vent temperature, about −35° F., in order to achieve a similar level of carbon dioxide retention over time as compared to a tobacco with a lower OV content, about 12%, with a post-vent temperature of about 0° F. to about 10° F. FIGS. 5 and 6, respectively, show the effect of tobacco OV content and post-vent temperature on equilibrated CV and specific volume of tobacco expanded after being held at its indicated post-vent temperature for the indicated time.

FIGS. 4, 5, and 6 are based on data from Runs 49, 54, and 65. In each of these runs, bright tobacco was placed in a pressure vessel with a total volume of 3.4 cubic feet, 2.4 cubic feet of which was occupied by the tobacco. In Runs 54 and 65, approximately 22 lbs. of 20% OV tobacco was placed in the pressure vessel. This tobacco was pre-cooled by flowing carbon dioxide gas through the vessel at about 421 psig and at about 153 psig for Runs 54 and 65, respectively, for about 4 to 5 minutes prior to pressurization to about 800 psig with carbon dioxide gas. In Run 49, approximately 13.5 pounds of tobacco at about 12.6% OV was placed in the pressure vessel which was then pressurized to about 800 psig with carbon dioxide gas without an intermediate cooling step. The mass of carbon dioxide in the vessel at 800 psig, the mass of tobacco loaded into the vessel at the lower bulk density of 12.6% OV tobacco and the lower heat capacity of the tobacco at 12.6% OV were such that the amount of carbon dioxide condensed on the tobacco required to achieve the final post-vent temperature of about 0° F. to 10° F. was negligible for Run 49.

Impregnation pressure, mass ratio of carbon dioxide to tobacco, and heat capacity of tobacco can be manipulated in such a manner that under specific circumstances, the amount of cooling required from the evaporation of condensed carbon dioxide is minimal relative to the cooling provided by the expansion of carbon dioxide gas upon depressurization. However, as the mass ratio of carbon dioxide gas to tobacco decreases, i.e., as the tobacco bulk density increases, the cooling required from the evaporation of condensed carbon dioxide increases. In order to achieve increased process throughput and more uniform tobacco expansion by pre-compacting the tobacco, it is preferred to achieve the controlled formation and evaporation of condensed carbon dioxide according to the invention.

In each of Runs 49, 54, and 65, after reaching the impregnation pressure of about 800 psig, the system pressure was held at about 800 psig for about 5 minutes before the vessel was rapidly depressurized to atmospheric pressure in approximately 90 seconds. The mass of carbon dioxide condensed per lb. of tobacco during pressurization after cooling was calculated for Runs 54 and 65 and is reported below. The impregnated tobacco was held at its post-vent temperature under a dry atmosphere until it was expanded in a 3-inch diameter expansion tower by contact with steam set at the indicated temperature and at a velocity of about 135 ft/sec for less than about 5 seconds.

TABLE 1

| Run | 49 | 54 | 65 |
|---|---|---|---|
| Feed OV % | 12.6 | 20.5 | 20.4 |
| Tobacco Wt. (lbs.) | 13.5 | 22.5 | 21.25 |
| $CO_2$ flow-thru cooling press. (psig) | none | 421 | 153 |
| Impreg. press (psig) | 800 | 800 | 772 |
| Pre-cool temp (°F.) | N/A | 10 | −20 |
| Post-vent temp. (°F.) | 0–10 | 10–20 | −35 |
| Expansion Tower gas temp (°F.) | 475 | 575 | 575 |
| Eq CV (cc/g) | 10.4 | 8.5 | 10.0 |
| SV (cc/g) | 3.1 | 1.8 | 2.5 |
| Calculated $CO_2$ condensed (lb./lb. tob.) | negligible | 0.19 | 0.58 |

The degree of tobacco stability required, and hence, the desired tobacco post-vent temperature, is dependent on many factors including the length of time after depressurization and before expansion of the tobacco. Therefore, the selection of a desired post-vent temperature should be made in light of the degree of stability required. According to another aspect of the process according to the invention taught herein, the impregnated tobacco is handled between the impregnation and expansion steps so as to maintain the tobacco's retention of carbon dioxide. For example, the tobacco should be conveyed by an insulated and cooled conveyor, and should be isolated from any moisture laden air.

The desired tobacco post-vent temperature may be obtained by any suitable means including pre-cooling of the tobacco before introducing it to the pressure vessel, in-situ cooling of the tobacco in the pressure vessel by purging with cold carbon dioxide or other suitable means, or vacuum cooling in situ augmented by flow through of carbon dioxide gas. Vacuum cooling has the advantage of reducing the tobacco OV content without thermal degradation of the tobacco. Vacuum cooling also removes non-condensible gases from the vessel, thereby allowing the purging step to be eliminated. Vacuum cooling can be effectively and practically used to reduce the tobacco temperature to as low as about 30° F. It is preferred that the tobacco is cooled in situ in the pressure vessel.

The amount of pre-cooling or in-situ cooling required to achieve the desired tobacco post-vent temperature is dependent on the amount of cooling provided by the expansion of the carbon dioxide gas during depressurization. The amount of tobacco cooling due to the expansion of the carbon dioxide gas is a function of the ratio of the mass of the carbon dioxide gas to the mass of tobacco, the heat capacity of the tobacco, the final impregnation pressure, and the system temperature. Therefore, for a given impregnation, when the tobacco feed and the system pressure, temperature and volume are fixed, control of the final post-vent temperature of the tobacco may be achieved by controlling the amount of carbon dioxide permitted to condense on the tobacco. The amount of tobacco cooling due to evaporation of the condensed carbon dioxide from the tobacco is a function of the ratio of the mass of condensed carbon dioxide to the mass of tobacco, the heat capacity of the tobacco, and the temperature or pressure of the system.

With the presence of condensed carbon dioxide, changes in bulk density do not significantly affect post vent temperatures. When the tobacco is compacted prior to impregnation with carbon dioxide, a greater bulk density results and allows a greater tobacco mass to be filled into a given impregnation vessel. The increase in tobacco bulk density can increase the production rate of the process. Although the preferred embodiment describes execution of the compacting step to achieve greater bulk density as including mechanical compaction with a piston, any alternative, or non-mechancial methods or apparatus for compacting tobacco could be utilized.

Figure 13:
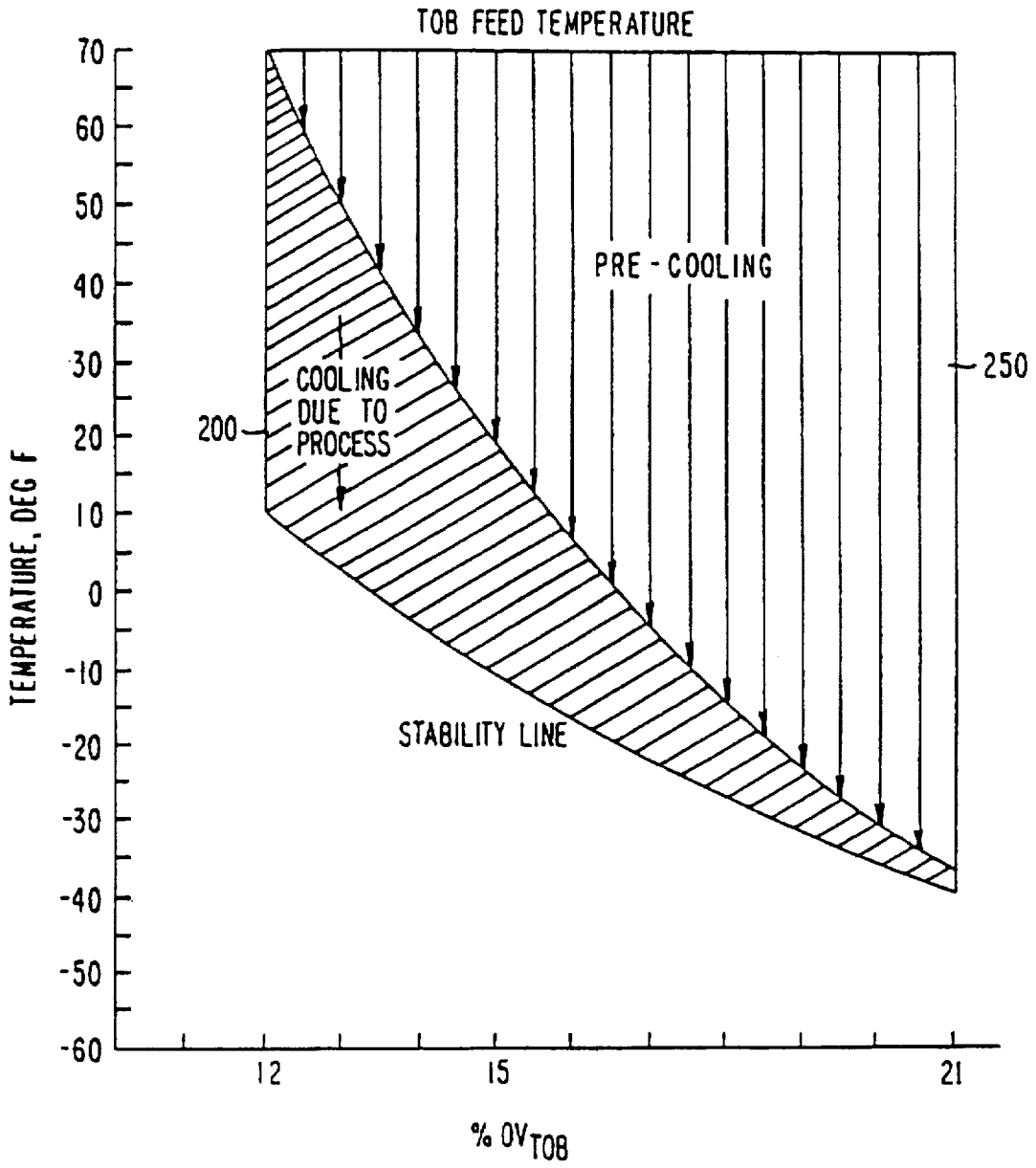
FIG. 13 is a plot of tobacco temperature versus tobacco OV showing the amount of pre-cooling required to achieve adequate stability (e.g., about 1 hour post-vent hold before expansion) for tobacco impregnated at 800 psig.

The required tobacco stability is determined by the specific design of the impregnation and expansion processes used. FIG. 13 illustrates the tobacco post-vent temperature required to achieve the desired tobacco stability as a function of OV for a particular process design. The lower shaded area 200 illustrates the amount of cooling contributed by carbon dioxide gas expansion and the upper area 250 illustrates the amount of additional cooling required by carbon dioxide liquid evaporation as a function of tobacco OV to provide the required stability. For this example, adequate tobacco stability is achieved when the tobacco temperature is at or below the temperature shown by the "stability" line. The process variables which determine the tobacco post-vent temperature include the variables discussed previously and other variables including, but not limited to, vessel temperature, vessel mass, vessel volume, vessel configuration, flow geometry, equipment orientation, heat transfer rate to the vessel walls, and process designed retention time between impregnation and expansion.

For the 800 psig process illustrated in FIG. 13, with a post-vent hold time of about 1 hour, no pre-cooling is required for 12% OV tobacco to achieve the required stability, whereas 21% OV tobacco requires sufficient pre-cooling to achieve a post-vent temperature of about −35° F.

The desired tobacco post-vent temperature of the present invention, from about −35° F. to about 20° F., is significantly higher than the post-vent temperature—about −110° F.—when liquid carbon dioxide is used as the impregnant. This higher tobacco post-vent temperature and lower tobacco OV allow the expansion step to be conducted at a significantly lower temperature, resulting in an expanded tobacco with less toasting and less loss of flavor. In addition, less energy is required to expand the tobacco. Moreover, because very little, if any, solid carbon dioxide is formed, handling of the impregnated tobacco is simplified. Unlike tobacco impregnated with only liquid carbon dioxide, tobacco impregnated according to the present invention does not tend to form clumps which must be mechanically broken. Thus, a greater usable-tobacco yield is achieved because the clump-breaking step which results in tobacco fines too small for use in cigarettes is eliminated.

Moreover, about 21% OV tobacco at about −35° F. to about 12% OV tobacco at about 20° F., unlike any OV tobacco at about −110° F., is not brittle and, therefore, is handled-with minimum degradation. This property results in a greater yield of usable tobacco because less tobacco is mechanically broken during normal handling, e.g., during unloading of the pressure vessel or transfer from the pressure vessel to the expansion zone.

Chemical changes during expansion of the impregnated tobacco, e.g., loss of reducing sugars and alkaloids upon heating, can be reduced by increasing the exit tobacco OV, i.e., the tobacco OV content immediately after expansion, to about 6% OV or higher. This can be accomplished by reducing the temperature of the expansion step. Normally, an increase in tobacco exit OV is coupled with a decrease in the amount of expansion achieved. The decrease in the amount of expansion depends strongly on the starting feed OV content of the tobacco. As the tobacco feed OV is reduced to approximately 13%, minimal reduction in the degree of expansion is observed even at a tobacco moisture content of about 6% or more exiting the expansion device. Therefore, if the feed OV and the expansion temperature are reduced, surprisingly good expansion can be attained while chemical changes are minimized. This is shown in FIGS. 7, 8 and 9.

Figure 7:
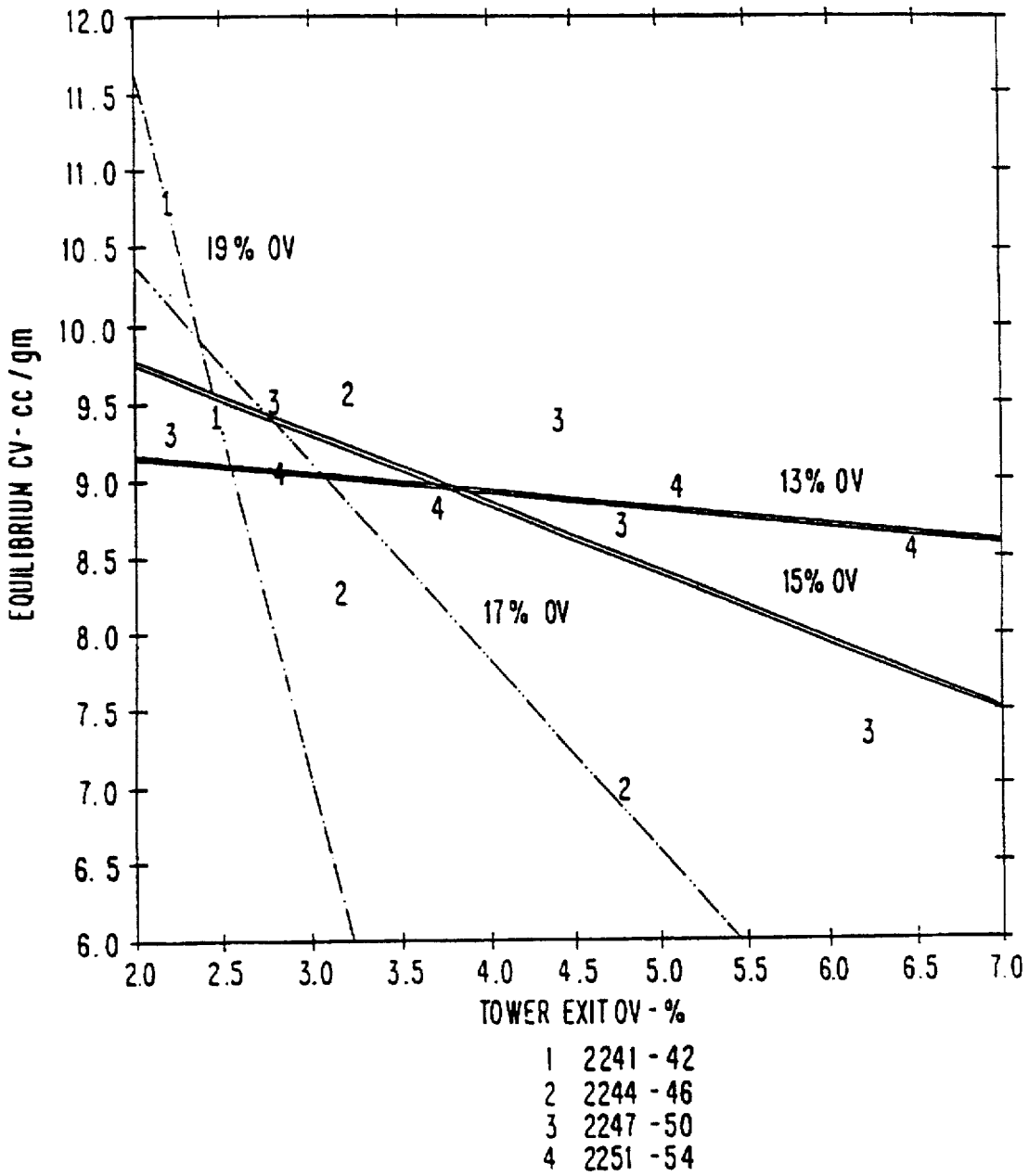
FIG. 7 is a plot of expanded tobacco equilibrium CV versus expansion tower exit OV content.
Figure 8:
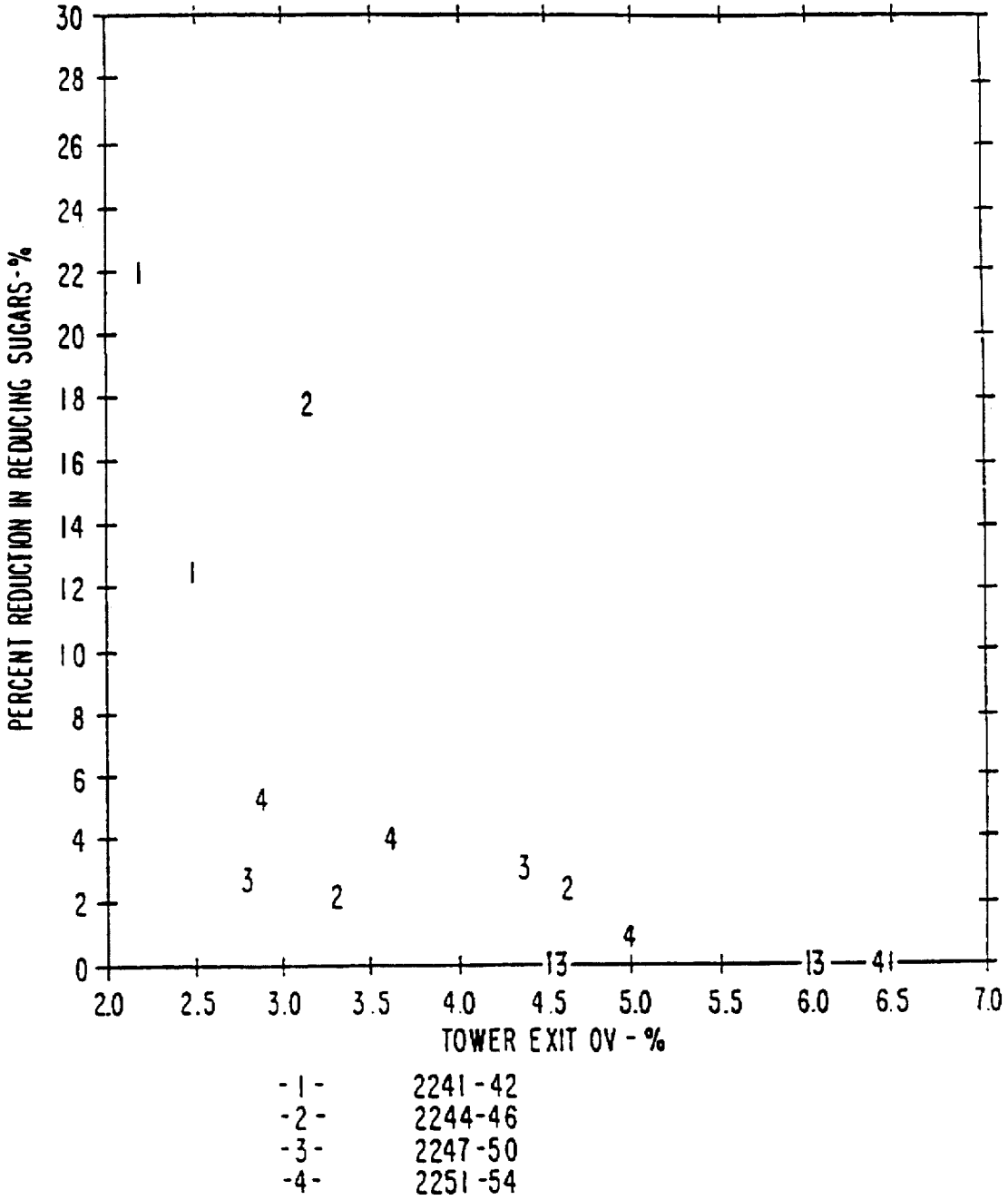
FIG. 8 is a plot of percent reduction in tobacco reducing sugars versus expansion tower exit OV content.
Figure 9:
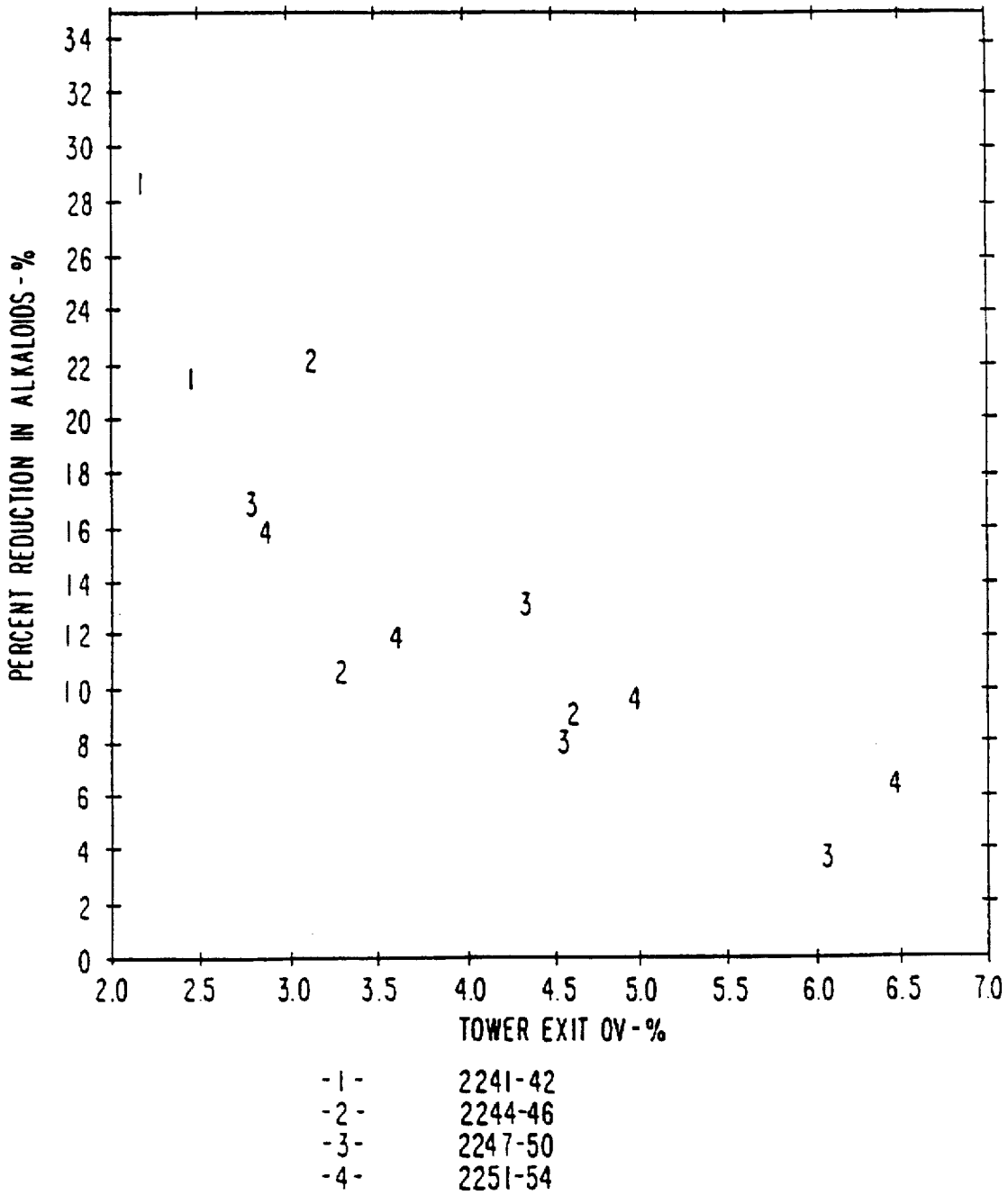
FIG. 9 is a plot of percent reduction in tobacco alkaloids versus expansion tower exit OV content.

FIGS. 7, 8, and 9 are based on data from Runs 2241 thru 2242 and 2244 thru 2254. This data is tabulated in Table 2. In each of these runs a measured amount of bright tobacco was placed in a pressure vessel similar to the vessel described in Example 1.

TABLE 2

| Run No. | 2241 | 2242 | 2244–46(3rd) | 2245(2nd) |
|---|---|---|---|---|
| Tobacco wt (lb.) | 100 | 100 | 325 | 325 |
| $CO_2$ condensed (lb./lb.) (calculated) | Not applicable | Not applicable | 0.36 | 0.36 |
| Tower Temp (°F.) | 625 | 675 | 500 | 550 |
| Feed: As Is OV | 18.8 | 18.9 | 17.0 | 17.2 |
| Eq OV | 12.2 | 12.1 | 12.2 | 12.1 |
| Eq CV (cc/g) | 4.5 | 4.6 | 4.8 | 4.9 |
| SV (cc/g) | 0.8 | 0.9 | 0.8 | 0.8 |
| Tower: As Is OV | 2.5 | 2.2 | 4.6 | 3.3 |
| Eq OV | 11.5 | 11.2 | 11.9 | 11.8 |
| Eq CV (cc/g) | 9.5 | 10.8 | 7.1 | 8.2 |
| SV (cc/g) | 3.0 | 3.1 | 1.8 | 2.3 |
| Feed: | | | | |
| Alkaloids* | 2.71 | 2.71 | 2.71 | 2.71 |
| Reducing Sugars* | 13.6 | 13.6 | 13.6 | 13.6 |
| Tower Exit: | | | | |
| Alkaloids* | 2.12 | 1.94 | 2.47 | 2.42 |
| % Reduction | 21.8 | 28.4 | 8.9 | 10.7 |

TABLE 2-continued

| | | | | |
|---|---|---|---|---|
| Reducing Sugars* | 11.9 | 10.6 | 13.3 | 13.3 |
| % Reduction | 12.5 | 22.0 | 2.2 | 2.2 |

| Run No. | 2246(1st) | 2247–48(1st) | 2248(2nd) | 2249–50(1st) |
|---|---|---|---|---|
| Tobacco wt (lb.) | 325 | 240 | 240 | 240 |
| $CO_2$ Condensed (lb./lb.) (calculated) | 0.36 | 0.29 | 0.29 | 0.29 |
| Tower Temp (°F.) | 600 | 400 | 450 | 500 |
| Feed: As Is OV | 17.5 | 14.30 | 14.2 | 15.2 |
| Eq OV | 12.0 | 11.6 | 11.8 | 11.8 |
| Eq CV (cc/g) | 4.9 | 5.2 | 5.3 | 5.3 |
| SV (cc/g) | 0.8 | 0.8 | 0.8 | 0.8 |
| Tower: As Is OV | 3.1 | 6.1 | 4.6 | 4.4 |
| Eq OV | 11.6 | 12.0 | 11.6 | 11.5 |
| Eq CV (cc/g) | 9.5 | 7.4 | 8.7 | 9.4 |
| SV (cc/g) | 2.8 | 2.2 | 2.6 | 2.9 |
| Feed: | | | | |
| Alkaloids* | 2.71 | 2.71 | 2.71 | 2.71 |
| Reducing Sugars* | 13.6 | 13.6 | 13.6 | 13.6 |
| Tower Exit: | | | | |
| Alkaloids* | 2.12 | 2.61 | 2.49 | 2.36 |
| % Reduction | 21.8 | 3.7 | 8.1 | 12.9 |
| Reducing Sugars* | 11.2 | 13.6 | 13.6 | 13.2 |
| % Reduction | 17.6 | 0 | 0 | 2.9 |

| Run No. | 2250 (2nd) | 2251–52(1st) | 2252 (2nd) | 2253–54(1st) | 2254 (2nd) |
|---|---|---|---|---|---|
| Tobacco wt (lb.) | 240 | 210 | 210 | 210 | 210 |
| $CO_2$ Condensed (lb./lb.) (calculated) | 0.29 | 0.25 | 0.25 | 0.25 | 0.25 |
| Tower Temp (°F.) | 550 | 375 | 425 | 475 | 525 |
| Feed: As Is OV | 15.0 | 12.9 | 13.0 | 12.8 | 12.9 |
| Eq OV | 11.9 | 12.0 | 11.6 | 11.8 | 12.0 |
| Eq CV (cc/g) | 5.3 | 5.4 | 5.4 | 5.3 | 5.4 |
| SV (cc/g) | 0.8 | 0.8 | 0.8 | 0.8 | 0.8 |
| Tower: As Is OV | 2.8 | 6.5 | 5.0 | 3.60 | 2.9 |
| Eq OV | 11.4 | 12.2 | 12.1 | 11.8 | 11.7 |
| Eq CV (cc/g) | 9.4 | 8.6 | 8.9 | 8.9 | 9.1 |
| SV (cc/g) | 3.0 | 2.6 | 2.8 | 3.1 | 3.2 |
| Feed: | | | | | |
| Alkaloids* | 2.71 | 2.71 | 2.71 | 2.71 | 2.71 |
| Reducing Sugars* | 13.6 | 13,.6 | 13.6 | 13.6 | 13.6 |
| Tower Exit: | | | | | |
| Alkaloids* | 2.26 | 2.54 | 2.45 | 2.39 | 2.28 |
| % Reduction | 16.6 | 6.3 | 9.6 | 11.8 | 15.9 |
| Reducing Sugars* | 13.2 | 13.6 | 13.5 | 13.1 | 12.9 |
| % Reduction | 2.9 | 0 | 0.7 | 3.7 | 5.1 |

*weight %, dry weight basis

Liquid carbon dioxide at 430 psig was used to impregnate the tobacco in Runs 2241 and 2242. The tobacco was allowed to soak in the liquid carbon dioxide for about 60 seconds before the excess liquid was drained. The vessel was then rapidly depressurized to atmospheric pressure, forming solid carbon dioxide in situ. The impregnated tobacco was then removed from the vessel and any clumps which may have formed were broken. The tobacco was then expanded in an 8-inch expansion tower by contact with a 75% steam/air mixture set at the indicated temperature and a velocity of about 85 ft/sec for less than about 4 seconds.

The nicotine alkaloids and reducing sugars content of the tobacco prior to and after expansion were measured using a Bran Luebbe (formerly Technicon) continuous flow analysis system. An aqueous acetic acid solution is used to extract the nicotine alkaloids and reducing sugars from the tobacco. The extract is first subjected to dialysis which removes major interferences of both determinations. Reducing sugars are determined by their reaction with p-hydroxybenzoic acid hydrazide in a basic medium at 85° C. to form a color. Nicotine alkaloids are determined by their reaction with cyanogen chloride, in the presence of aromatic amine. A decrease in the alkaloids or the reducing sugars content of the tobacco is indicative of a loss of or change in chemical and flavor components of the tobacco.

Runs 2244 thru 2254 were impregnated with gaseous carbon dioxide at 800 psig according to the method described in Example 1. In order to study the effect of expansion temperature, tobacco from a single impregnation was expanded at different temperatures,. For example, 325 lbs. of tobacco were impregnated and then three samples, taken over the course of about 1 hour, were tested and expanded at 500° F., 550° F., and 600° F., representing Runs 2244, 2245, and 2246, respectively. In order to study the effect of OV content, batches of tobacco with OV contents of about 13%, 15%, 17%, and 19% were impregnated. The notation 1st, 2nd, or 3rd next to the run number indicates the order in which the tobacco was expanded from a particular impregnation. The impregnated tobacco was expanded in an 8-inch expansion tower by contact with a 75% steam/air mixture set at the indicated temperature and a velocity of about 85 ft/sec for less than about 4 seconds. The alkaloids and reducing sugars content of the tobacco were measured in the same manner as described above.

Figure 2:
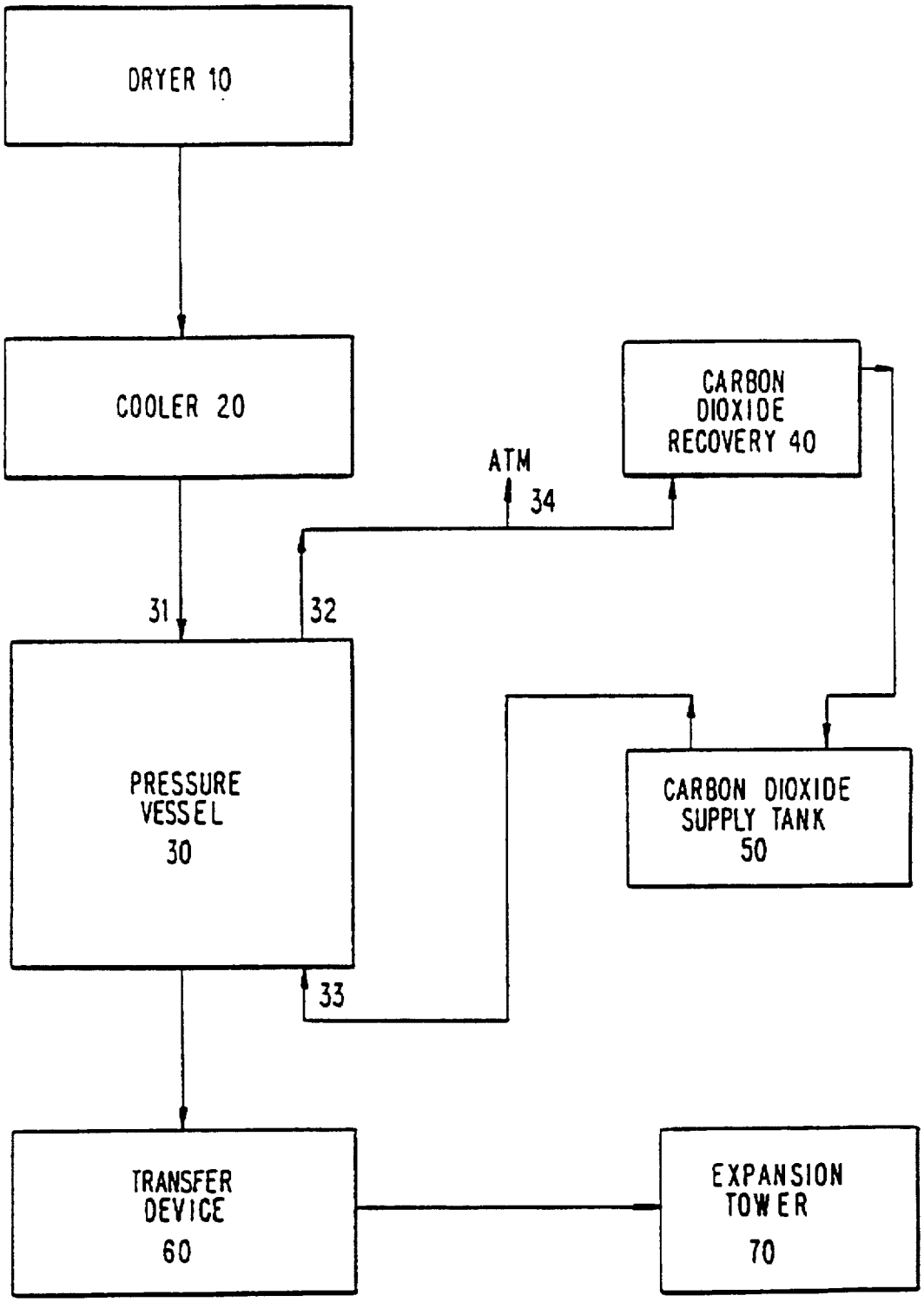
FIG. 2 is a simplified block diagram of a process for expanding tobacco incorporating one form of the present invention.

Referring to FIG. 2, tobacco to be treated is introduced to the dryer 10, where it is dried from about 19% to about 28% moisture (by weight) to from about 12% to about 21% moisture (by weight), preferably about 13% to about 15% moisture (by weight). Drying may be accomplished by any suitable means. This dried tobacco may be stored in bulk in a silo for subsequent impregnation and expansion or it may be fed directly to the pressure vessel 30 after suitable temperature adjustment and compaction, if necessary.

Optionally, a measured amount of dried tobacco is metered by a weighbelt and fed onto a conveyor belt within the tobacco cooling unit 20 for treatment prior to impregnation. The tobacco is cooled within the tobacco cooling unit 20 by any conventional means including refrigeration, to less than about 20° F., preferably to less than about 0° F., before being fed to the pressure vessel 30.

Figure 2A:
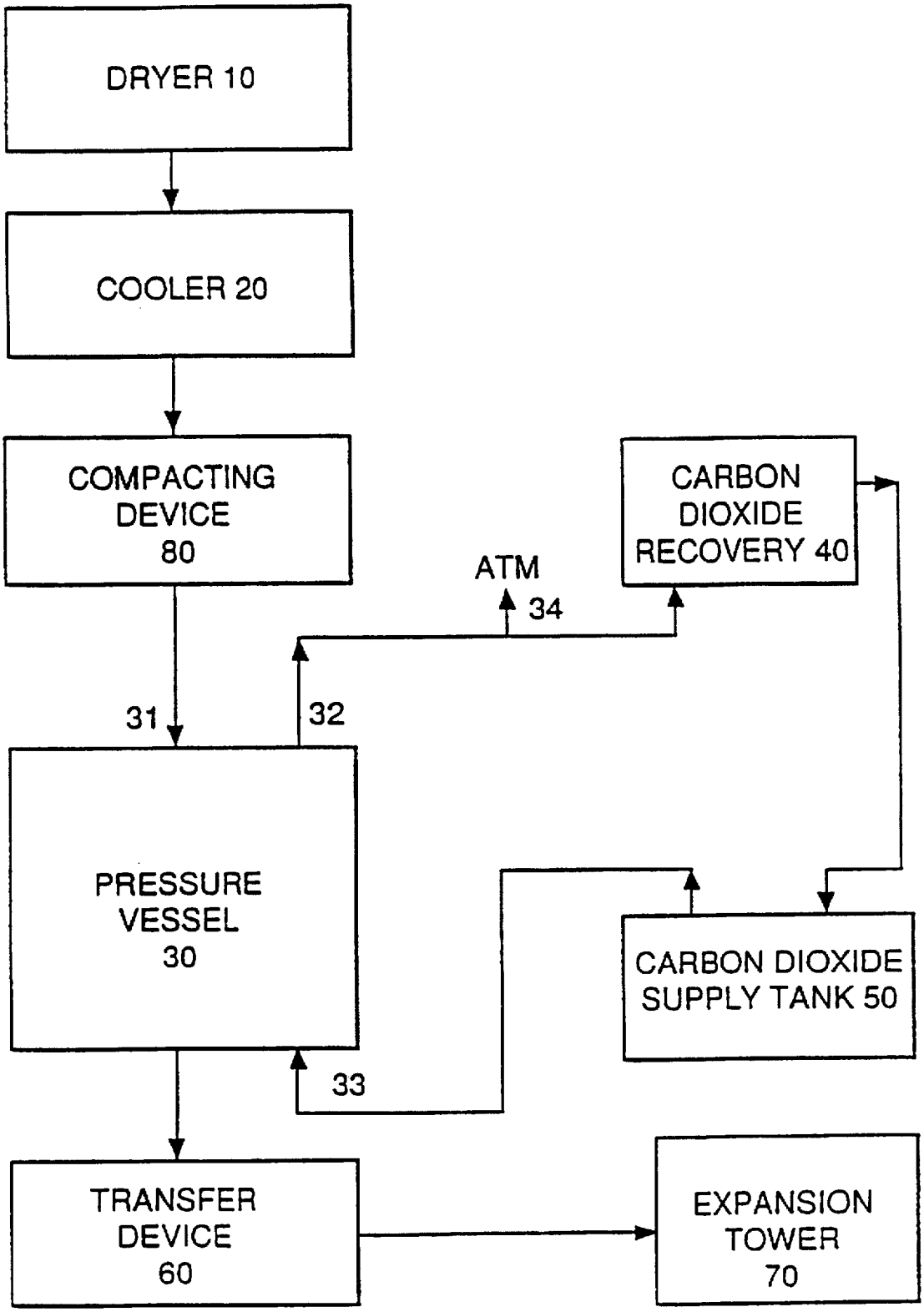
FIG. 2A is a variant of FIG. 2 showing a process for compacting, impregnating and expanding tobacco according to one embodiment of the present improvement invention.

The block diagram of FIG. 2A is similar to that of FIG. 2 but additionally shows a compacting device 80 for compacting the tobacco prior to its impregnation with carbon dioxide according to the improved embodiment of the present invention. The tobacco may be compacted in situ in the pressure vessel or in a separate compacting station, or both. Thus, the compacting device 80 may be independent from or integral with the pressure vessel 30, and includes the appropriate compacting arrangement and transport arrangement.

With 15% OV tobacco, the compacting device 80 compresses or compacts the tobacco from an initial loose bulk density up to a compacted bulk density of from about 10 to about 16 lbs./cu.ft., and preferably about 11 to about 15 lbs./cu.ft. It has been observed that 15% OV tobacco compacted to more than about 15 or 16 lbs./cu.ft. exhibits some clumping after being removed from the impregnation vessel.

For a small impregnator (e.g., about one cubic foot), the compacted bulk density of the tobacco is substantially uniform throughout the entire tobacco bed upon mechanical compaction. For a large impregnator, mechanical compaction provides a more uniform bulk density than would be achieved by gravity alone. For example, when bright tobacco of 20.5% OV was loosely filled into a cylinder about 69" high and about 24" in diameter, the measured bulk density was between about 23 and about 25.5 lbs./cu.ft. essentially uniformly at measurement points between 0" and about 20" high in the bed, diminished to about 21 lbs/cu.ft. at about 31.5" height, and then diminished essentially linearly from about 21 to about 14.5 lbs./cu.ft. between about 31.5" and the top of the bed. If a tobacco bed is compacted to at least the threshold bulk density, the gravitational compacting effect is negligible, and the bulk density will be substantially uniform throughout the bed.

The following procedure was used to measure bulk density at different depths in a tobacco bed. Pre-weighed amounts of tobacco, e.g., 5 pound amounts, were placed one after another into a cylinder. A marker was placed into the cylinder after each 5 pound amount of tobacco. When the cylinder was filled with tobacco, with markers interposed between successive 5 pound amounts of tobacco, the cylinder was carefully removed to leave standing a column of tobacco and markers. The height of each marker was measured and used to calculate the volume occupied by, and the bulk density of, the associated 5 pound amount of tobacco.

The cooled and compacted tobacco is fed to the pressure vessel 30 through the tobacco inlet 31 where it is deposited. Preferably, the pressure vessel 30 is a cylinder having a vertically extending longitudinal axis, with a carbon dioxide supply inlet 33 arranged at or near the bottom of the vessel 30 and a carbon dioxide vent outlet 32 arranged at or near the top of the vessel 30. However, venting may be achieved in any convenient direction, e.g., vertically, horizontally, radially, etc., because the process of the invention achieves substantially uniform temperatures throughout the tobacco bed due to the uniform controlled condensation of carbon dioxide. Furthermore, the bed is essentially homogenous and uniform and allows a uniform gas flow in any direction.

The pressure vessel 30 is then purged with gaseous carbon dioxide, to remove any air or other non-condensible gases from the vessel 30. Alternatively, the pressure vessel may be evacuated using a vacuum pump to remove air or other gases before carbon dioxide gas is introduced into the vessel. It is desireable that the purge be conducted in such a manner as not to significantly raise the temperature of the tobacco in the vessel 30. Preferably, the effluent of this purge step is treated in any suitable manner to recover the carbon dioxide for reuse or it may be vented to atmosphere through line 34.

Following the purge step, carbon dioxide gas is introduced to the pressure vessel 30 from the supply tank 50 where it is maintained at about 400 psig to about 1050 psig. When the inside pressure of the vessel 30 reaches from about 300 psig to about 500 psig, the carbon dioxide outlet 32 is opened allowing the carbon dioxide to flow through the tobacco bed cooling the tobacco to a substantially uniform temperature while maintaining the pressure of the vessel 30 at from about 300 psig to about 500 psig. After a substantially uniform tobacco temperature is reached, the carbon dioxide outlet 32 is closed and the pressure of the vessel 30 is increased to from about 700 psig to about 1000 psig, preferably about 800 psig, by the addition of carbon dioxide gas. Then the carbon dioxide inlet 33 is closed. At this point, the tobacco bed temperature is approximately at the carbon dioxide saturation temperature. While pressures as high as 1050 psig might be economically employed, and a pressure equal to the critical pressure of carbon dioxide, 1057 psig, would be acceptable, there is no known upper limit to the useful impregnation pressure range, other than that imposed by the capabilities of the equipment available and the effects of supercritical carbon dioxide on the tobacco.

During pressurization of the pressure vessel, it is preferred that a thermodynamic path is followed that allows a controlled amount of the saturated carbon dioxide gas to condense on the tobacco. FIG. 1 is a standard temperature (°F.)—entropy (Btu/lb°F.) diagram for carbon dioxide with line I–V drawn to illustrate one thermodynamic path in accord with the present invention. For example, tobacco at about 65° F. is placed in a pressure vessel (at I) and the vessel pressure is increased to about 300 psig (as shown by line I–II). The vessel is then cooled to about 0° F. by flow-thru cooling of carbon dioxide at about 300 psig (as shown by line II–III). Additional carbon dioxide gas is introduced to the vessel, raising the pressure to about 800 psig and the temperature to about 67° F. However, because the temperature of tobacco is below the saturation temperature of the carbon dioxide gas, a controlled amount of carbon dioxide gas will uniformly condense on the tobacco (as shown by line III–IV). After holding the system at about 800 psig for the desired length of time, the vessel is rapidly depressurized to atmospheric pressure resulting in a post-vent temperature of about −5° F. to about −10° F. (as shown by line IV–V).

In-situ cooling of the tobacco to about 10° F. prior to pressurization generally will allow an amount of the saturated carbon dioxide gas to condense. Condensation generally will result in a substantially uniform distribution of liquid carbon dioxide throughout the tobacco bed. Evaporation of this liquid carbon dioxide during the vent step will help cool the tobacco in a uniform manner. A uniform post-impregnation tobacco temperature results in a more uniform expanded tobacco. The uniform condensation of carbon dioxide on the tobacco and the resultant uniform cooling of the tobacco is promoted according to the preferred embodiment wherein the tobacco has been pre-compressed to a substantially uniform bulk density.

Figure 10:
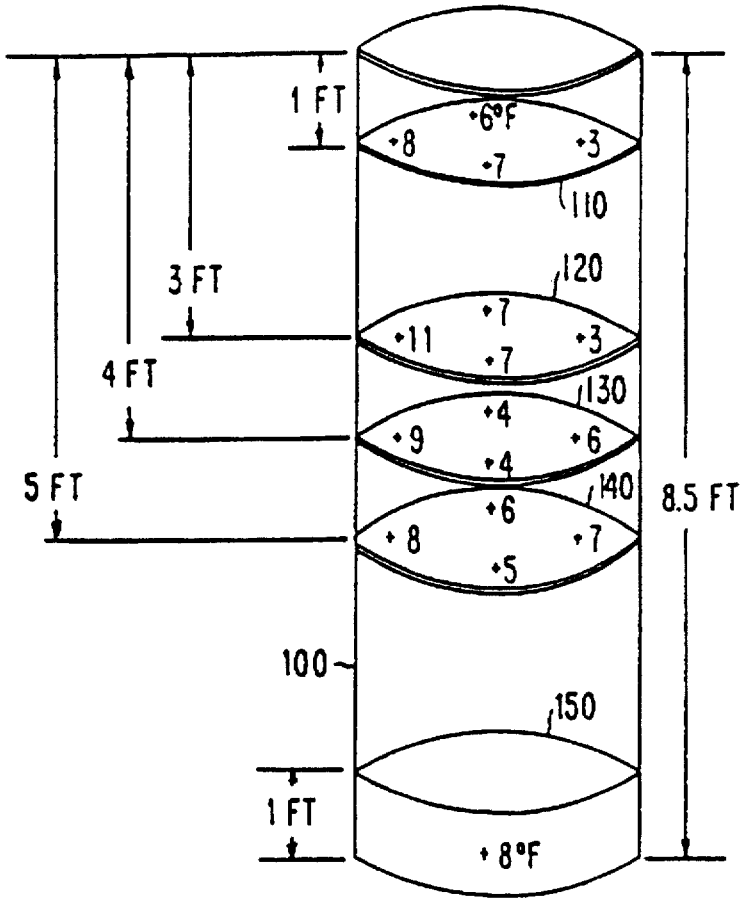
FIG. 10 is a schematic diagram of an impregnation vessel showing the tobacco temperature at various points throughout the tobacco bed after venting.

This uniform tobacco temperature is illustrated in FIG. 10, which is a schematic diagram of the impregnation vessel 100 used in Run 28 showing the temperature, in OF, at various locations throughout the tobacco bed after venting. For example, the tobacco-bed temperature at cross-section 120, 3 feet from the top of vessel 100, was found to have temperatures of about 11° F., 7° F., 7° F., and 3° F. About 1800 lbs. of bright tobacco with an OV content of about 15% was placed in a 5 ft (i.d.)×8.5 ft (ht) pressure vessel. The vessel was then purged with carbon dioxide gas for about 30 seconds before pressurizing to about 350 psig with carbon dioxide gas. The tobacco bed was then cooled to about 10° F. by flow-thru cooling at 350 psig for about 12.5 minutes. The vessel pressure was then increased to about 800 psig and held for about 60 seconds before rapidly depressurizing in about 4.5 minutes. The temperature of the tobacco bed at various points was measured and found to be substantially uniform as shown in FIG. 10. It was calculated that about 0.26 lbs. of carbon dioxide condensed per lb. of tobacco.

Returning to FIG. 2, the tobacco in the pressure vessel 30 is maintained under carbon dioxide pressure at about 800 psig for from about 1 second to about 300 seconds, preferably about 60 seconds. It has been discovered that tobacco contact time with carbon dioxide gas, i.e., the length of time that the tobacco must be maintained in contact with the carbon dioxide gas in order to absorb a desired amount of carbon dioxide, is influenced strongly by the tobacco OV content and the impregnation pressure used. Tobacco with a higher initial OV content requires less contact time at a given pressure than tobacco with a lower initial OV content in order to achieve a comparable degree of impregnation particularly at lower pressures. At higher impregnation pressures, the effect of tobacco OV on contact time with the carbon dioxide gas is reduced. This is illustrated in Table 3.

TABLE 3

Effects of Impregnation Pressure And Tobacco OV On Contact Time With $CO_2$

| Run | 20 | 14 | 21 | 59 | 49 | 33 | 32 | 35 | 30 | 27 |
|---|---|---|---|---|---|---|---|---|---|---|
| Initial Tob OV (%) | 12.2 | 11.7 | 11.8 | 12.3 | 12.6 | 16.7 | 16.4 | 16.9 | 16.5 | 16.0 |
| Impregnation Pressure (psig) | 471 | 462 | 465 | 802 | 800 | 430 | 430 | 430 | 460 | 450 |
| Contact Time at Impregnation Press. (minutes) | 5 | 15 | 60 | 1 | 5 | 0.25 | 5 | 10 | 15 | 20 |
| Tower Exit: | | | | | | | | | | |
| Eq CV (cc/g) | 7.5 | 8.7 | 10.1 | 9.8 | 10.4 | 8.5 | 9.3 | 10.5 | 11.1 | 10.5 |
| SV (cc/g) | 1.8 | 2.1 | 2.8 | 3.1 | 3.1 | 2.1 | 2.6 | 3.4 | 3.1 | 2.9 |
| Control* | | | | | | | | | | |
| Eq CV (cc/g) | 5.3 | 5.4 | 5.2 | 5.6 | 5.7 | 5.5 | 5.5 | 5.7 | 5.5 | 5.5 |
| SV (cc/g) | 0.8 | 0.8 | 0.8 | 0.8 | 0.8 | 0.8 | 0.8 | 0.8 | 0.8 | 0.8 |

*CV and SV of feed tobacco

After the tobacco has soaked sufficiently, the pressure vessel 30 is depressurized rapidly to atmospheric pressure in from about 1 second to about 300 seconds, depending on vessel size, by venting the carbon dioxide first to the carbon dioxide recovery unit 40 and then through line 34 to atmosphere. Carbon dioxide which has condensed on the tobacco is vaporized during this vent step, helping to cool the tobacco, resulting in a tobacco post-vent temperature of from about −35° F. to about 20° F.

Impregnated tobacco from the pressure vessel 30 may be expanded immediately by any suitable means, e.g., by feeding to the expansion tower 70. Alternatively, impregnated tobacco may be maintained for about 1 hour at its post-vent temperature in the tobacco transfer device 60 under a dry atmosphere, i.e., an atmosphere with a dewpoint below the post-vent temperature, for subsequent expansion. After expansion and, if desired, reordering, the tobacco may be used in the manufacture of tobacco products, including cigarettes.

The following examples are illustrative:

EXAMPLE 1

A 240 pound sample of bright tobacco filler with a 15% OV content was cooled to about 20° F. and then placed in a pressure vessel approximately 2 feet in diameter and approximately 8 feet in height. The vessel was then pressured to about 300 psig with carbon dioxide gas. The tobacco was then cooled, while maintaining the vessel pressure at about 300 psig, to about 0° F. by flushing with carbon dioxide gas near saturated conditions for about 5 minutes prior to pressurizing to about 800 psig with carbon dioxide gas. The vessel pressure was maintained at about 800 psig for about 60 seconds. The vessel pressure was decreased to atmospheric pressure by venting in about 300 seconds, after which the tobacco temperature was found to be about 0° F. Based on the tobacco temperature, the system pressure, temperature, and volume, and the tobacco post-vent temperature, it was calculated that approximately 0.29 lbs. of carbon dioxide condensed per lb. of tobacco.

The impregnated sample had a weight gain of about 2% which is attributable to the carbon dioxide impregnation. The impregnated tobacco was then, over a one hour period, exposed to heating in an 8-inch diameter expansion tower by contact with a 75% steam/air mixture at about 550° F. and a velocity of about 85 ft/sec for less than about 2 seconds. The product exiting the expansion tower had an OV content of about 2.8%. The product was equilibrated at standard conditions of 75° F. and 60% RH for about 24 hours. The filling power of the equilibrated product was measured by the standardized cylinder volume (CV) test. This gave a CV value of 9.4 cc/g at an equilibrium moisture content of 11.4%. An unexpanded control was found to have a cylinder volume of 5.3 cc/g at an equilibrium moisture content of 12.2%. The sample after processing, therefore, had a 77% increase in filling power as measured by the CV method.

Figure 11:
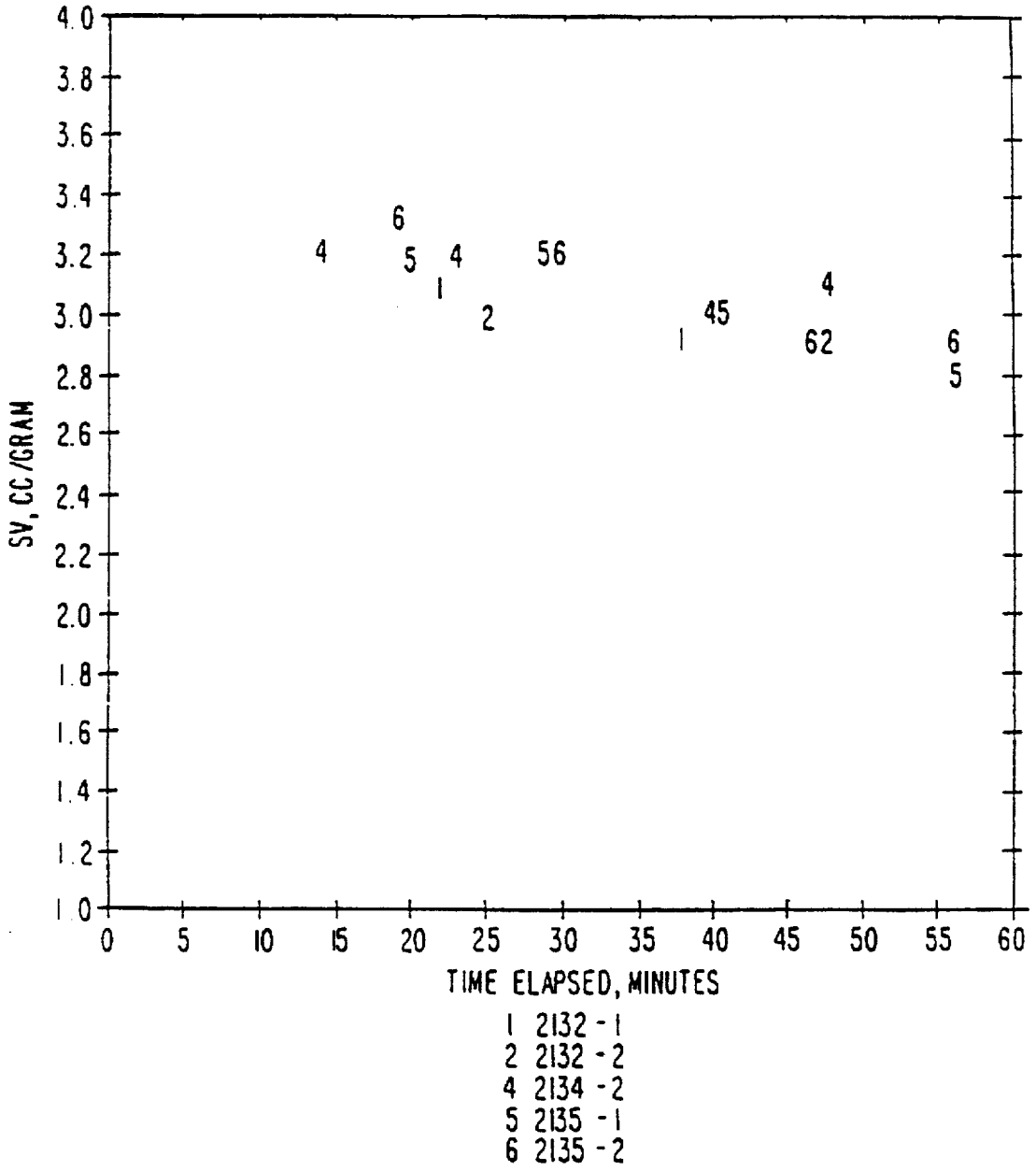
FIG. 11 is a plot of expanded tobacco specific volume versus hold-time after impregnation prior to expansion.
Figure 12:
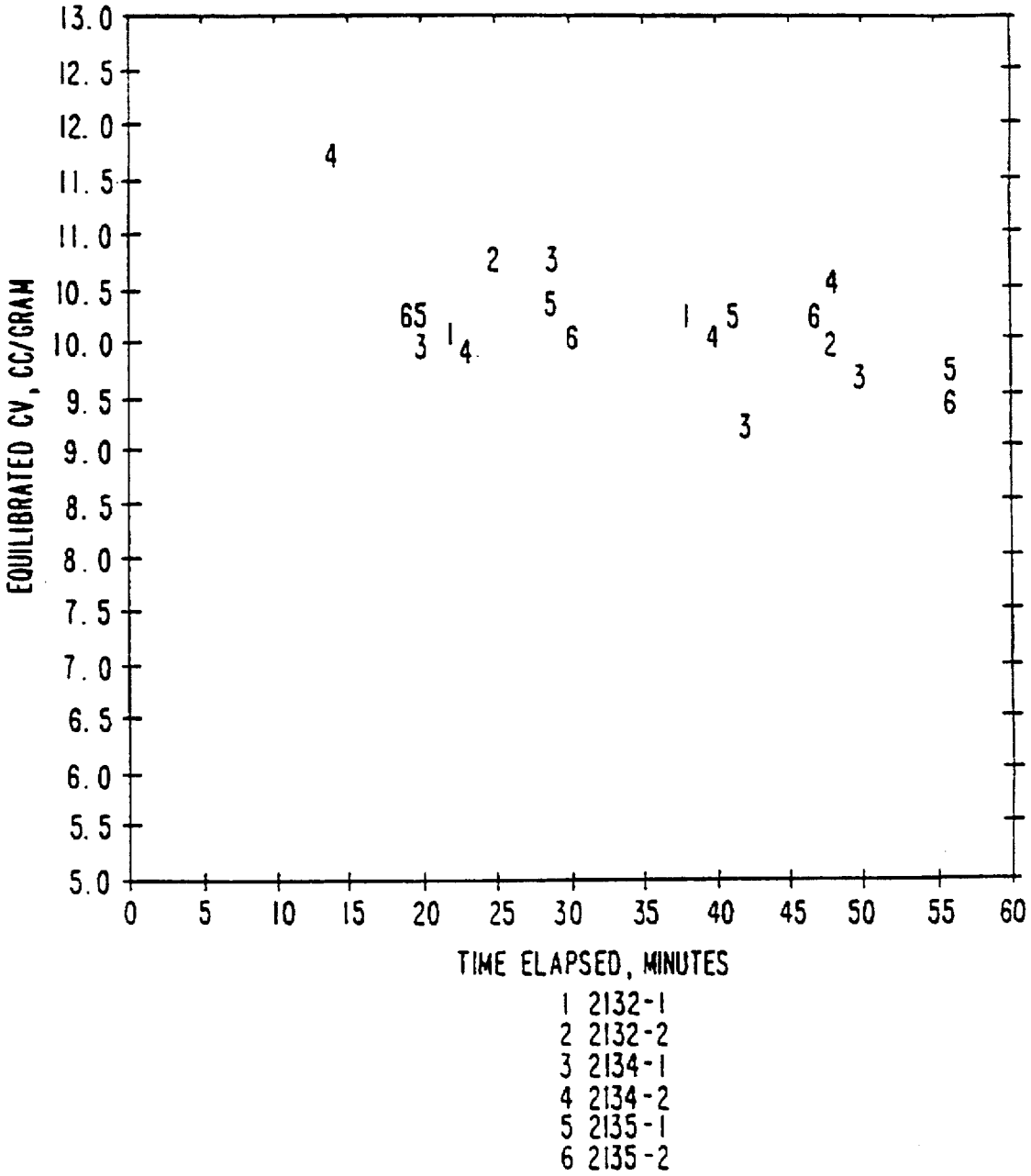
FIG. 12 is a plot of expanded tobacco equilibrium CV versus hold-time after impregnation prior to expansion.

The effect of hold time after impregnation prior to expansion on expanded tobacco SV and equilibrated CV was studied in Runs 2132-1 thru 2135-2. In each of these runs, 2132-1, 2132-2, 2134-1, 2134-2, 2135-1, and 2135-2, 225 lbs. of bright tobacco with a 15% OV content was placed in the same pressure vessel as described in Example 1. The vessel was pressured to from about 250 psig to about 300 psig with carbon dioxide gas. The tobacco was then cooled, while maintaining the vessel pressure at about 250 psig to about 300 psig, in the same manner as described in Example 1. The vessel was then pressurized to about 800 psig with carbon dioxide gas. This pressure was maintained for about 60 seconds before the vessel was vented to atmospheric pressure in about 300 seconds. The impregnated tobacco was maintained in an environment with a dewpoint below the tobacco post-vent temperature prior to expansion. FIG. 11 illustrates the effect of hold time after impregnation on the specific volume of expanded tobacco. FIG. 12 illustrates the effect of hold time after impregnation on the equilibrated CV of expanded tobacco.

EXAMPLE 2

A 19 pound sample of bright tobacco filler with a 15% OV content was placed in a 3.4 cubic foot pressure vessel. The vessel was then pressured to about 185 psig with carbon dioxide gas. The tobacco was then cooled, while maintaining the vessel pressure at about 185 psig, to about −25° F. by flushing with carbon dioxide gas near saturated conditions for about 5 minutes prior to pressurizing to about 430 psig with carbon dioxide gas. The vessel pressure was maintained at about 430 psig for about 5 minutes. The vessel pressure was decreased to atmospheric pressure by venting in about 60 seconds, after which the tobacco temperature was found to be about −29° F. Based on the tobacco temperature, the system pressure, temperature, and volume, it was calculated that approximately 0.23 lbs. of carbon dioxide condensed per lb. of tobacco.

The impregnated sample had a weight gain of about 2% which is attributable to the carbon dioxide impregnation. The impregnated tobacco was then, over a one hour period, exposed to heating in an 3-inch diameter expansion tower by contact with a 100% steam at about 525° F. and a velocity of about 135 ft/sec for less than about 2 seconds. The product exiting the expansion tower had an OV content of about 3.8%. The product was equilibrated at standard conditions of 75° F. and 60% RH for about 24 hours. The filling power of the equilibrated product was measured by the standardized cylinder volume (CV) test. This gave an equilibrated CV value of 10.1 cc/g at an equilibrium moisture of 11.0%. An unexpanded control was found to have a cylinder volume of 5.8 cc/g at an equilibrium moisture of 11.6%. The sample after processing, therefore, had a 74% increase in filling power as measured by the CV method.

As already described, the process according to the invention may be advantageously adapted to a short-cycle impregnation of tobacco in relatively small batches, so that the process becomes essentially continuous. A preferred embodiment of such a process will now be described, as carried out in an apparatus according to the invention, with reference to FIGS. 14 to 19. The described embodiment is an example of a small-batch short-cycle impregnation process and apparatus to impregnate about 15% OV tobacco, at an output of approximately 500 pounds per hour with bulk density of about 14 lbs./cu.ft.

Figure 14:
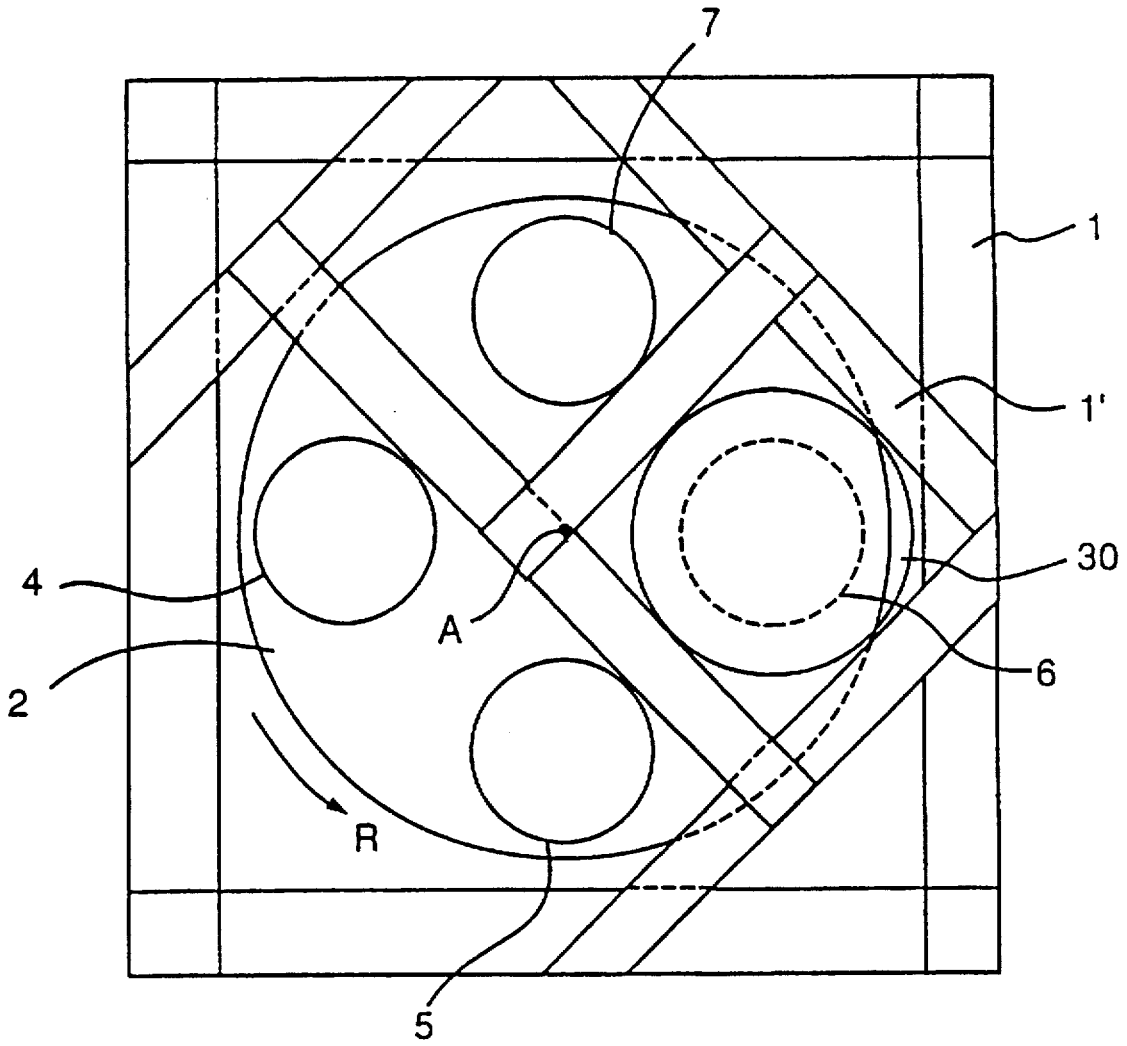
FIG. 14 is a schematic top view of an embodiment of an apparatus for carrying out a short cycle impregnation process on high bulk density tobacco according to the invention.

FIG. 14 is a schematic top view of an apparatus for carrying out the preferred process according to the invention. A stationary table 2' (FIG. 15) is mounted on a frame 1, and turntable 2 is mounted on the table 2'. Turntable 2 rotates counterclockwise (arrow R) about a substantially vertical axis A. An upper frame 1' carries a pressure vessel 30 as described, below.

The turntable 2 is driven to rotate (arrow R) in steps of substantially 90° by a drive arrangement, for example, an air actuator, a motor and blockable gear train or a stepper motor, which is not shown but which is generally understood by those skilled in the art. Mounted on the turntable 2 as described below are four similar cylindrical tubes, namely tube 4 shown in a feed or filling position, tube 5 shown in a pressing position, tube 6 shown below an impregnation station position, and tube 7 shown in a discharge position. As the drive arrangement rotates turntable 2 in 90° rotational steps, each tube 4, 5, 6 and 7 is rotated in about 4 seconds to the respective following process station and held there for about 96 seconds as described below.

Figure 15:
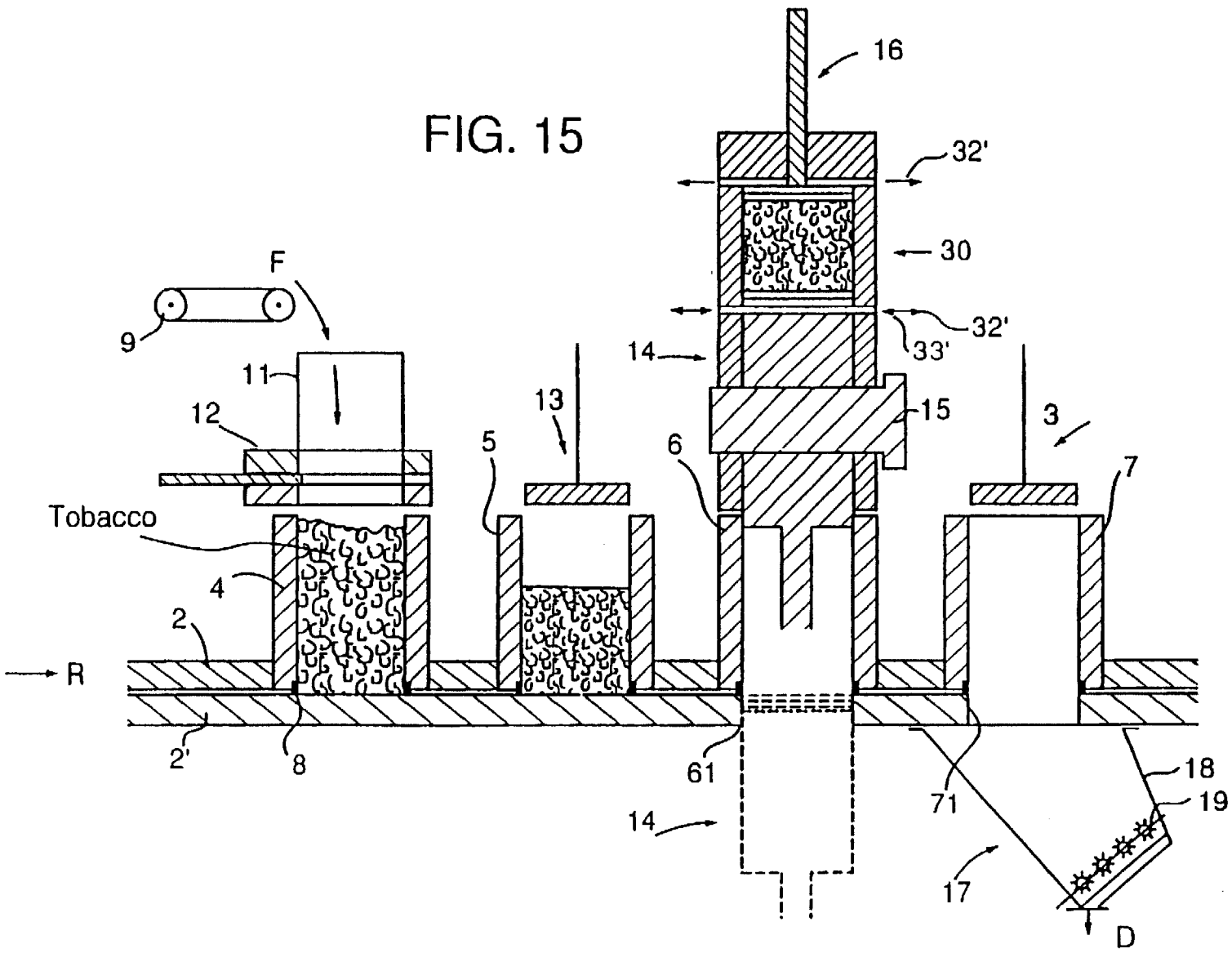
FIG. 15 is a schematic sectional elevation of the apparatus of FIG. 14.

FIG. 15 is a cylindrical sectional elevation of the apparatus of FIG. 14. The rotating turntable 2 is arranged directly above a stationary table 2', which is supported on frame 1. Conventional bearings may be provided to support turntable 2 on stationary table 2' to allow their relative rotational motion. The tubes 4, 5, 6 and 7 are each arranged in a corresponding hole in the turntable 2, so that each tube remains open from the top and from the bottom through the turntable 2. A wiper 8 may be arranged at the bottom of each tube to wipe against table 2' to prevent tobacco from accumulating in the space between turntable 2 and table 2'.

A feed conveyor 9 delivers loose bulk tobacco (e.g., 15% OV content tobacco) in an essentially continuous stream (arrow F) into a surge chute or surge tube 11. The tobacco may, for example, have been pretreated by a dryer 10 and a cooler 20 referenced in FIG. 2, before being delivered by feed conveyor 9. The tobacco falls through the surge tube 11 and through an open slide gate 12 into the tube 4 in the feed position. The tobacco feed rate is controlled so that tube 4 is filled substantially to the top during a one-station cycle time of about 96 seconds. Turntable 2 then rotates within about 4 seconds to move tube 4 into the compacting or pressing station occupied by tube 5 in the view of FIG. 15, corresponding generally to the compacting device 80 of FIG. 2*a*.

While the turntable 2 rotates between successive stopped positions as described, the slide gate 12 closes and stops the flow of loose tobacco, which then backs-up or stockpiles in surge tube 11 until the next tube (e.g., tube 7) is positioned below slide gate 12, whereupon slide gate 12 opens.

Each tube is about 24" in length, with an inner diameter of about 14" and a wall thickness adequate to withstand compaction forces on the tobacco. When a filled tube is in the pressing position of tube 5, a compaction piston assembly 13 is activated. The assembly corresponds generally to compacting device 80 of FIG. 2*a* and may, for example, be a hydraulically driven piston and cylinder. Piston assembly 13 compresses or compacts the tobacco to about half of its initial loose fill volume and about almost twice its initial loose fill bulk density, i.e., raising the bulk density to about 13 lbs./cu.ft.

After compressing the tobacco, the compaction piston assembly 13 retracts before a one-station cycle time of about 96 seconds has expired. Then the tube containing compacted tobacco is rotated in about 4 seconds to the impregnation position of tube 6 and positioned in alignment with a hole 61 in table 2'. A pressure vessel piston assembly 14 moves from a position shown by broken lines below turntable 2, through hole 61 and through tube 6. Piston assembly 14 carries the pre-compacted tobacco out of tube 6 and into pressure vessel 30. Piston assembly 14 then compresses the tobacco further, to a bulk density of about 14 lbs./cu.ft. Then locking pin 15 locks piston assembly 14 into place, and the compressed tobacco is impregnated with carbon dioxide within pressure vessel 30 according to the process of the invention as more particularly described below.

Thereafter, locking pin 15 is moved to an unlocked position, piston assembly 14 is withdrawn from pressure vessel 30, and simultaneously ejection piston 16 is driven downward to ensure that the impregnated bed of tobacco is completely cleared from the pressure vessel. Once piston assembly 14 is clear of the bottom of tube 6 and piston 16 is retracting back toward its starting position, tube 6 may be rotated to carry the impregnated tobacco to the discharge station of tube 7 in FIG. 15.

A discharge assembly 3, such as a piston, moves down through tube 7 to assure that the impregnated tobacco is completely cleared from tube 7 and then retracts. The tobacco falls through a hole 71 in table 2' and into a discharge hopper assembly 17. Hopper assembly 17 is insulated and cooled with chilled, dry air (at a temperature below the post-vent temperature of the tobacco) to preserve the carbon dioxide impregnation of the tobacco. Hopper assembly 17 includes a surge hopper 18 and a plurality of pinned doffers or so-called opening rollers 19. The hopper assembly evens out the individual batches of impregnated tobacco (about 14 lbs. each in this example) into a continuous bulk flow D of tobacco and VT reconfigures the shape of the tobacco flow D to prevent "choke-feeding" the expansion apparatus. Tobacco experiences a period of retention in the hopper assembly 17 for a period of time referred to in the art as bulking time. The extent of bulking time is dependent upon the frequency at which the hopper assembly 17 receives tobacco from the impregnator. A shorter impregnation cycle reduces the bulking time for each batch of tobacco, lessening stability requirements of carbon dioxide retention within the tobacco. Because $CO_2$ stability has an inverse relationship with the post-vent exit temperature of the tobacco, a shorter cycle provides not only effective operation at reduced stability, but can also do so at higher post-vent exit temperatures than a longer cycle.

Figure 16:
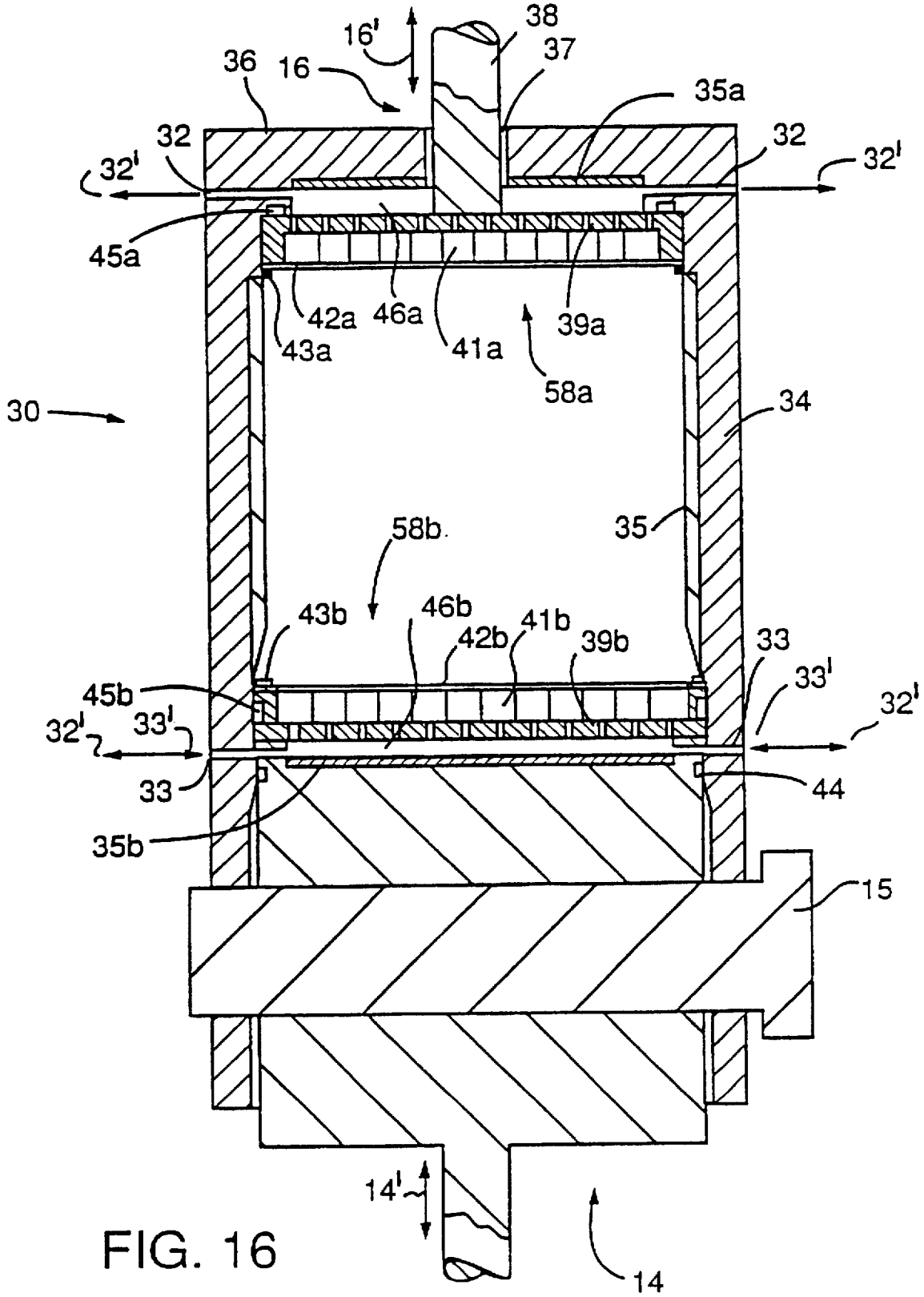
FIG. 16 is an enlarged section through the pressure vessel of FIG. 15, viewed in essentially the same direction as the viewing direction of FIG. 15.

FIG. 16 is an enlarged sectional view of the pressure vessel arrangement 30 of FIG. 15, after the pressure vessel piston 14 has pushed a pre-compacted tobacco bed (not shown for better clarity) into the pressure vessel, further compacted the tobacco, and been locked in place by locking pin 15. Pressure vessel 30 includes a cylinder 34 such as a cylinder obtainable from Autoclave Engineering, Inc. or Pressure Products, Inc., having a 14" internal diameter. Cylinder 34 is preferably lined with a thermally insulating liner 35 having a wall thickness of about 0.125". The ejection piston assembly 16 is arranged to move in the directions of arrow 16' through a hole fitted with a pressure seal 37 in the top 36 of the cylinder 34. A shaft 38 of piston assembly 16 carries an upper gas distributor plate 39*a*, an upper gas chamber plate 41*a* and an upper screen 42*a*.

The screen 42*a*, plate 41*a* and plate 39*a* form an upper gas distributor assembly 58*a*, dimensioned to fit closely but movably within the insulating liner 35, with a wiper 43*a* arranged around the circumference of screen 42*a*. At the opposite end of pressure vessel 30, the piston assembly 14 includes a similar arrangement of a lower screen 42*b* with a wiper 43*b*, a lower gas chamber plate 41*b* and a lower gas distributor plate 39*b*. The components 42*b*, 41*b* and 39*b* form a lower gas distributor assembly 58*b*, dimensioned to fit slideably within the inner diameter of cylinder 34, e.g., less than about 14".

Thus, a tobacco containing cavity is formed, bounded radially by the inner walls of liner 35, on the top by screen 42*a*, and on the bottom by screen 42*b*. Pressure seal 37 around the shaft of ejection piston 16 and a pressure seal 44 around the upper portion of pressure vessel piston 14 are high pressure seals to confine the carbon dioxide gas at impregnation pressures. A low pressure seal 45*a* is arranged between gas distributor plate 39*a* and the top of the cylinder 34, and a low pressure seal 45*b* is arranged between the circumference of the lower gas distributor assembly 58 and the inner wall of cylinder 34. Low pressure seals 45*a* and 45*b* may be O-ring seals, which only need to withstand the low pressure differential across the respective gas distributor plates, gas chamber plates, screens and the tobacco bed. These seals 45*a* and 45*b* ensure that gas is properly distributed through the gas distributor assemblies and consequently through the tobacco bed, rather than passing along the walls of the pressure vessel.

In order to impregnate the compacted tobacco with carbon dioxide according to the process of the invention, a control valve (not shown) is opened so that carbon dioxide gas is introduced (arrows 33') through gas inlets 33, then through gas plenum 46*b*, plates 39*b* and 41*b* and screen 42*b* to permeate the tobacco bed and flow out through the corresponding upper components 42*a*, 41*a*, 39*a*, 46*a* and 32.

As carbon dioxide gas flows in, air is purged from the tobacco bed and escapes through screen 42*a*, plates 41*a* and 39*a*, and then via gas plenum 46*a* through gas outlets 32 to a control valve (not shown) by which gas may be vented to atmosphere or recovered in a recovery arrangement 40 (FIG. 2). Preferably, inlets 33 are arranged at or near the bottom of plenum 46*b* to allow any condensate to drain, and outlets 32 are arranged at or near the top of plenum 46*a* to allow any heat of compression to vent rather than forming trapped "hot spots."

Alternatively, air or other gases may be purged from the pressure vessel by applying a vacuum to the vessel. Vacuum purging is especially applicable to the pressure vessel of the present embodiment, because it contains a relatively low gas volume and a sufficient vacuum may be achieved in about 5 seconds.

Initially, the upper control valve is fully open to allow an air purge for about 5 seconds. Then the upper control valve is throttled to a pressure of about 250 psig, whereupon the pressure vessel pressures-up to about 250 psig in about 2 seconds while a very small amount of gas may still escape through the upper control valve. In order to cool the tobacco according to the invention, saturated carbon dioxide gas at about 250 psig is allowed to flow through the bed for about 56 seconds. The bed of tobacco is cooled uniformly to saturation conditions for the carbon dioxide at about 250 psig (see e.g., FIG. 1).

Then, the upper control valve is throttled to about 800 psig, whereupon carbon dioxide flows into the bed and pressures-up to about 800 psig in about 6 seconds while a very small amount of gas may still escape through the upper control valve. As the pressure increases (uniformly throughout the bed), the saturation temperature of the gas increases (also uniformly throughout the bed), so carbon dioxide condenses onto the cool tobacco uniformly through the bed. As the condensation warms the tobacco, the tobacco temperature lags behind the increasing saturation temperature of the carbon dioxide gas. Thus, condensate may continue to form until the pressure reaches about 800 psig.

It has been found that for selected pressures of about 750 psig or greater, for about 15% O.V. tobacco, no additional "soak time" is required at the selected high pressure in order to achieve sufficient impregnation. Therefore, when about 800 psig pressure is attained, the upper and lower control valves are both opened to allow venting of carbon dioxide through inlets 33 as well as outlets 32 (upper and lower arrows 32') for about 15 seconds back down to atmospheric pressure. The time required for venting may be reduced by venting the bed from both the top and the bottom. This short-cycle process to produce about 500 pounds per hour of impregnated tobacco at about 14 lbs./cu.ft. density is summarized below in Table 4. This short-cycle impregnation process according to the invention can be completed in about 100 seconds, because the purging, pressurization and venting steps can be carried out very quickly, and because a high pressure "soak time" as well as additional steps to overcome heat of compression can be eliminated.

TABLE 4

OPERATION SEQUENCE

| APPROX. TIME (seconds) | OPERATION |
|---|---|
| 4 | move pressure vessel piston and ejection piston up to charge tobacco |
| 2 | lock locking pin |
| 5 | flow $CO_2$ to purge air |
| 2 | pressure-up to 250 psig |
| 56 | flow-through $CO_2$ at 250 psig |
| 6 | pressure-up to 800 psig |
| 0 | flow-through "soak time" at 800 psig |
| 15 | vent |
| 2 | unlock locking pin |

TABLE 4-continued

| OPERATION SEQUENCE | |
|---|---|
| APPROX. TIME (seconds) | OPERATION |
| 4 | move pressure vessel piston and ejection piston down to remove tobacco from impregnator |
| 4 | rotate table about 90° |
| 100 | Approx. batch cycle time |

During venting, some cooling is provided by expansion of the gas, but the majority of cooling is provided by evaporation of condensed carbon dioxide. The cooling effect brings the tobacco bed temperature uniformly to about 0° F. or less in this example. The post vent temperature can be controlled by controlling pre-cooling of the tobacco and the pressure-up cycle parameters, such as the flow-through pressure and the maximum pressure, in order to control the amount of condensation achieved. Therefore, uniform cooling, impregnation and post-vent stability can be achieved regardless of bed density.

A further advantage of the short-cycle impregnation process according to the invention is that an essentially continuous output of about 500 to 520 lbs./hr. is achieved by operating as described with a total per-batch cycle time of about 100 seconds and a batch weight of about 14 to 15 pounds (about 15% initial OV tobacco compacted to about 14 lbs./cu.ft.). In fact, the above described example embodiment was designed to achieve a rated output of just over 500 lbs./hr. Other output rates can be achieved simply by appropriately redesigning apparatus dimensions and process variables.

Figure 17:
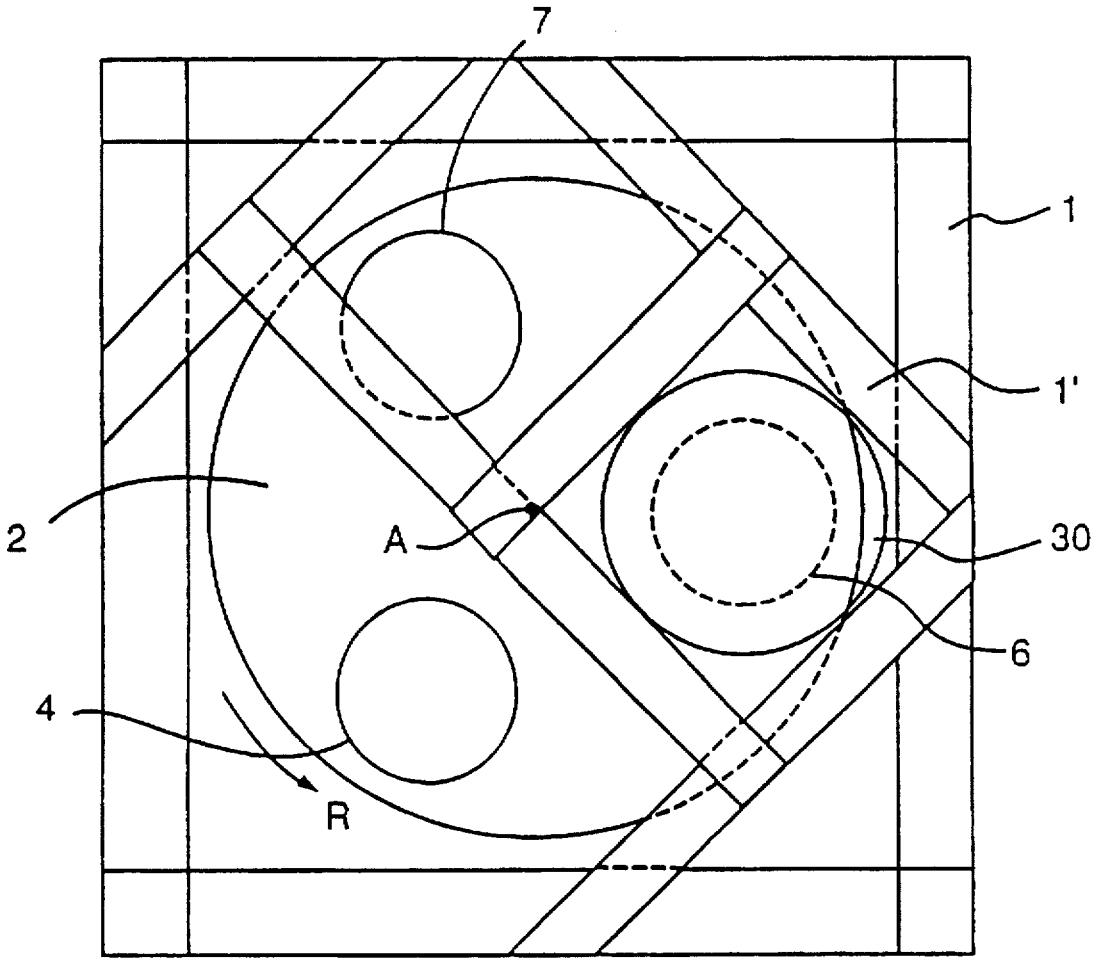
FIG. 17 is a top view similar to that of FIG. 14, but of another embodiment of the apparatus of the invention.

FIG. 17 is a schematic top view of a further variation of the apparatus described above. This apparatus is similar to the one described above and operates in a generally similar manner, but combines the filling position with the compacting position.

In this embodiment, three similar cylindrical tubes, namely tube 4 shown in a feed or filling position, tube 6 shown below an impregnation station position, and tube 7 shown in a discharge position. As the drive arrangement rotates turntable 2 in 120° rotational steps, each tube 4, 6 and 7 is rotated in about 4 seconds to the respective following process station and held there for about 102 seconds as described below.

Figure 18:
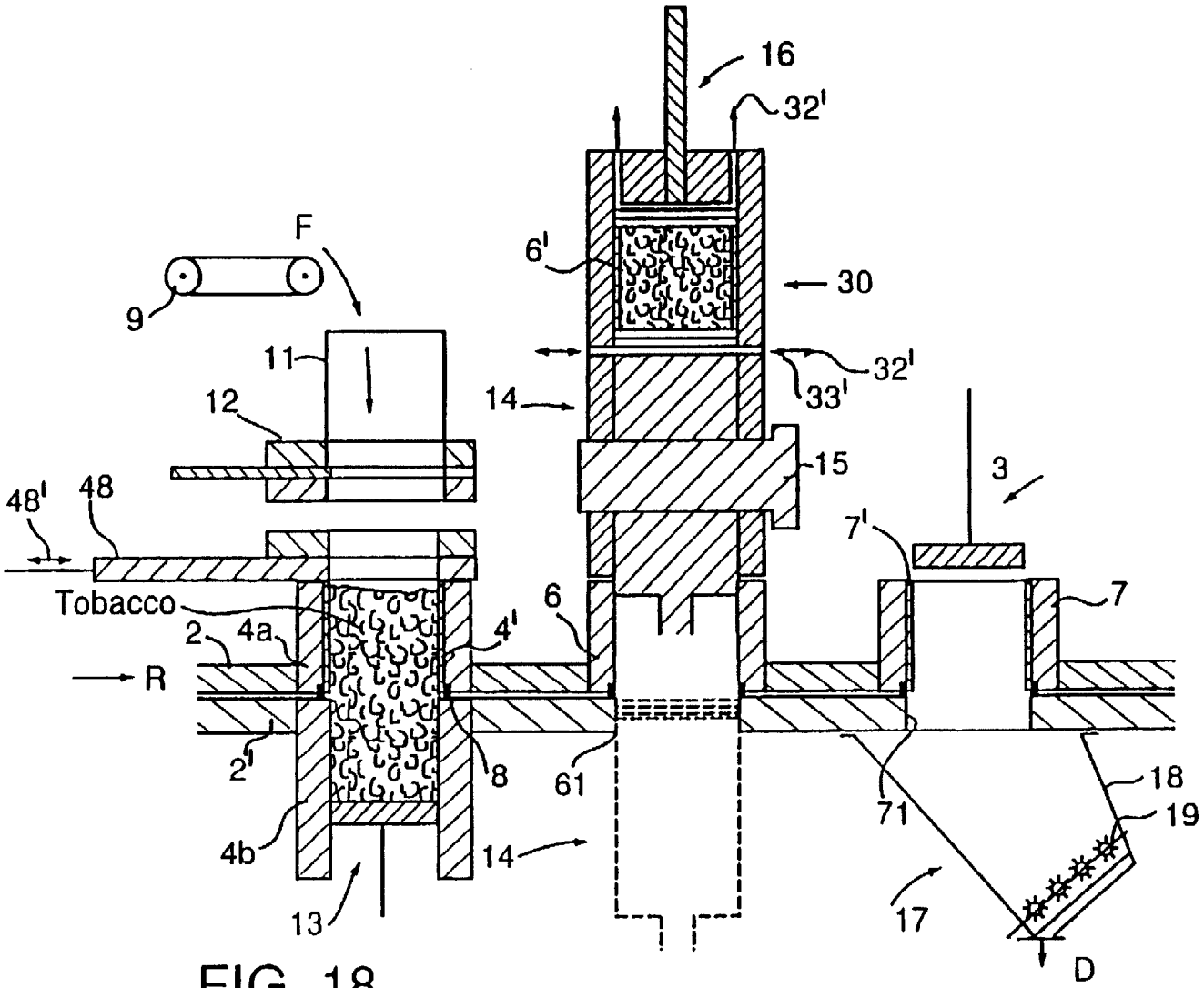
FIG. 18 is a view similar to that of FIG. 15, but of the apparatus of FIG. 17.

FIG. 18 is a cylindrical sectional elevation of the apparatus of FIG. 17. The description referring to FIG. 15 generally applies to FIG. 18. However, only three tubes, 4, 6 and 7, are each arranged in a corresponding hole in the turntable 2. Tube 4 includes an upper tube **4*a*, which rotates on turntable 2, and a lower tube 4*b*, which is mounted in stationary table 2'. As turntable 2 rotates to successive stopped positions, tubes 4*a*, 6 and 7 will sequentially be aligned over lower tube 4*b*. A respective compaction sleeve 4', 6' and 7' is positioned in each tube 4*a*, 6 and 7. In this embodiment, each sleeve 4', 6' and 7' is about 13" long, with an inner diameter of about 13.5" and a wall thickness of about 0.25". The sleeves fit closely but movably within the respective tube 4*a*, 6 or 7**. Each sleeve preferably is made of a thermally insulating material and preferably is perforated by several pressure equalization holes as described below.

The feed rate of tobacco is controlled so that a desired amount of tobacco is filled into tube **4*b* and sleeve 4' in about 90 seconds. Then slide plate 12 is closed and compacting backup plate 48 moves (arrow 48') into position at the top of tube 4*a* in about 2 seconds. Alternatively, components 12 and 48 may be combined in one assembly. Then compactor 13 compacts the tobacco in about 10 seconds. The starting position of compactor 13 can be adjusted depending on the desired amount of tobacco per charge. Turntable 2 then rotates within about 4 seconds to move tube 4*a* and sleeve 4' filled with compacted tobacco into the impregnation position of tube 6**.

A pressure vessel piston assembly 14 moves from a position shown by broken lines below table 2', through hole 6' and through tube 6. Piston assembly 14 carries the compaction sleeve 6' and pre-compacted tobacco contained in the sleeve out of tube 6 and into pressure vessel 30. Then locking pin 15 locks piston assembly 14 into place, and the compressed tobacco is impregnated with carbon dioxide within pressure vessel 30 according to the process of the invention generally as described above.

Locking pin 15 is moved to an unlocked position, piston assembly 14 is withdrawn from pressure vessel 30, and simultaneously ejection piston 16 is driven downward to ensure that compaction sleeve 6' and the impregnated bed of tobacco is completely cleared from the pressure vessel. Once piston assembly 14 is clear of the bottom of tube 6 and piston 16 is retracting back toward its starting position, tube 6 may be rotated to carry sleeve 6' containing the impregnated tobacco within tube 6 to the discharge station of tube 7 in FIG. 18.

Figure 19:
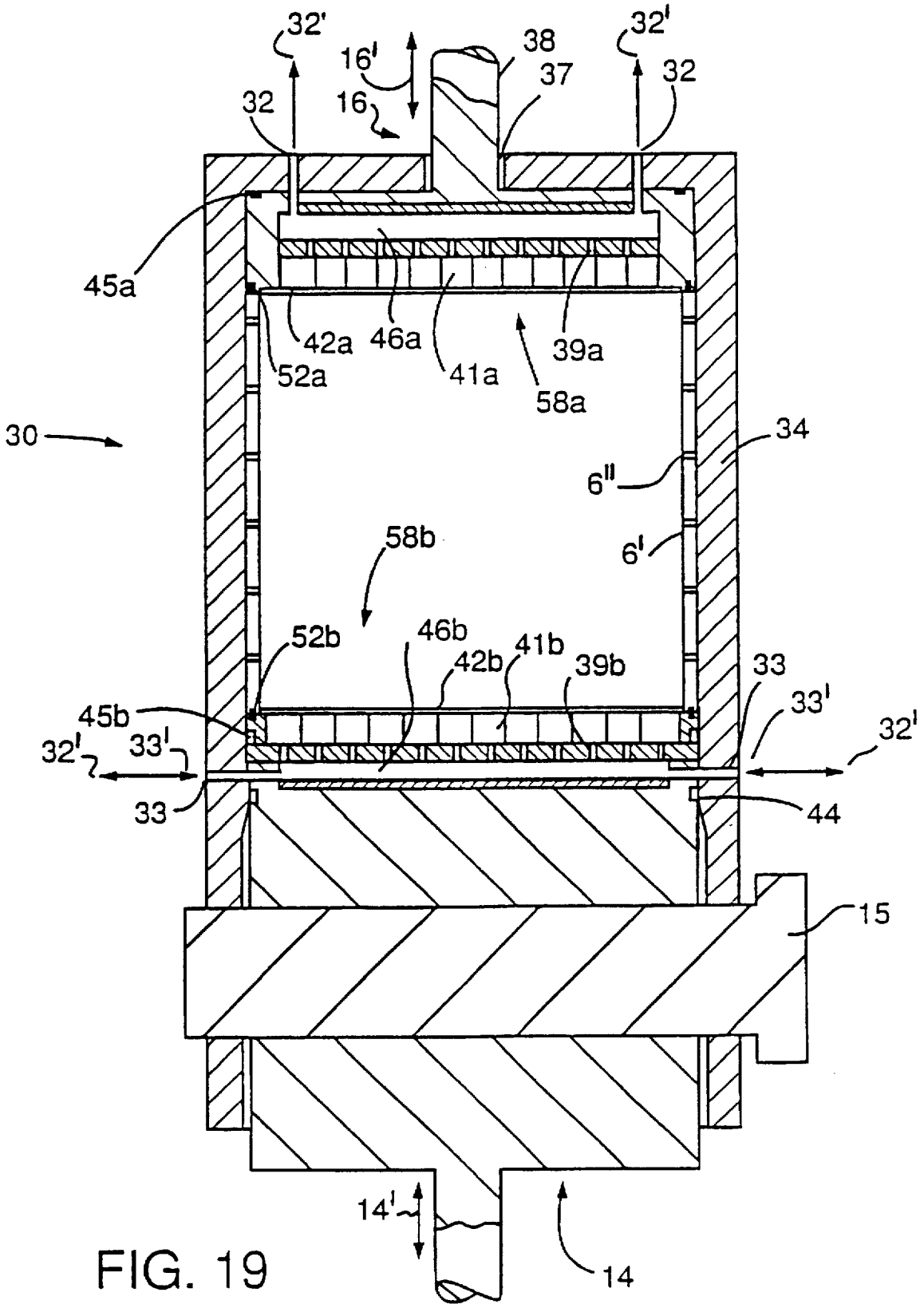
FIG. 19 is a view similar to that of FIG., 16, but of the apparatus of FIG. 18.

FIG. 19 is an enlarged sectional view of the pressure vessel arrangement 30 of FIG. 18, after the pressure vessel piston 14 has pushed compaction sleeve 6' containing a pre-compacted tobacco bed (not shown for better clarity) into the pressure vessel and been locked in place by locking pin 15. Cylinder 34 in this embodiment is not lined with a thermally insulating liner 35, but rather receives the insulating sleeve 6'.

Thus, a tobacco containing cavity is formed, bounded radially by the inner walls of sleeve 6', on the top by screen **42*a*, and on the bottom by screen 42*b*. A low pressure seal 45*a* is arranged between gas distributor assembly 58*a* and top of cylinder 34. Low pressure seal 52*a* mounted on the assembly 58*a* is arranged between assembly 58*a* and the top edge of sleeve 6'. Low pressure seal 52*b* is arranged between assembly 58*b* and the bottom edge of sleeve 6'. Low pressure seals 45*a* and mounted 52*a* on the assembly 58*a*, and seals 45*b* and 52*b* mounted on assembly 58*b*, may be O-ring seals, which only need to withstand the low pressure differential across the respective gas distributor plates, gas chamber plates, screen and tobacco bed. These seals ensure that gas is properly distributed through the screens rather than passing along the walls of the pressure vessel. The sleeve 6' may be perforated by holes 6"** to ensure that no pressure differential exists across the wall of the sleeve.

In this embodiment, the outlet 32 are arranged in the top of cylinder 34, to vent upwards (arrows 32'). Gas plenum **46*a* is formed as a cavity within the upper distributor assembly 58*a***.

The impregnation process is similar to that described above, and summarized in Table 4. However, in this embodiment, the pressure-up to about 250 psig is achieved in about 2 seconds, the flow-through at about 250 psig is carried out for about 61 seconds, and the pressure-up to about 800 psig is achieved in about 7 seconds. Thus the total impregnation cycle requires about 102 seconds.

When the process according to the invention is carried out as a small-batch, short-cycle impregnation in an essentially continuously operating apparatus as described, the impregnation vessel may become cooled further on each cycle. If so, then condensation or frosting may occur. If the "snowball effect" is problematic under the desired operating conditions, heaters 35*a* and 35*b*, or thermal insulation, can be arranged in the gas plenums as shown in FIG. 16 and FIG. 19. The thermally insulating liner 35 of FIG. 16 and sleeve 6' of FIG. 19 serves the same purpose of insulating the metal cylinder 34 from the cold tobacco bed and gas. The heaters can be controlled, for example to be activated between impregnation cycles, in order to prevent ever-increasing chilling and resultant frosting of the metal surfaces. Alternatively, hot gas, such as heated air at about 70° to about 150° F. can be directed into the pressure vessel between impregnation cycles.

Figure 20:
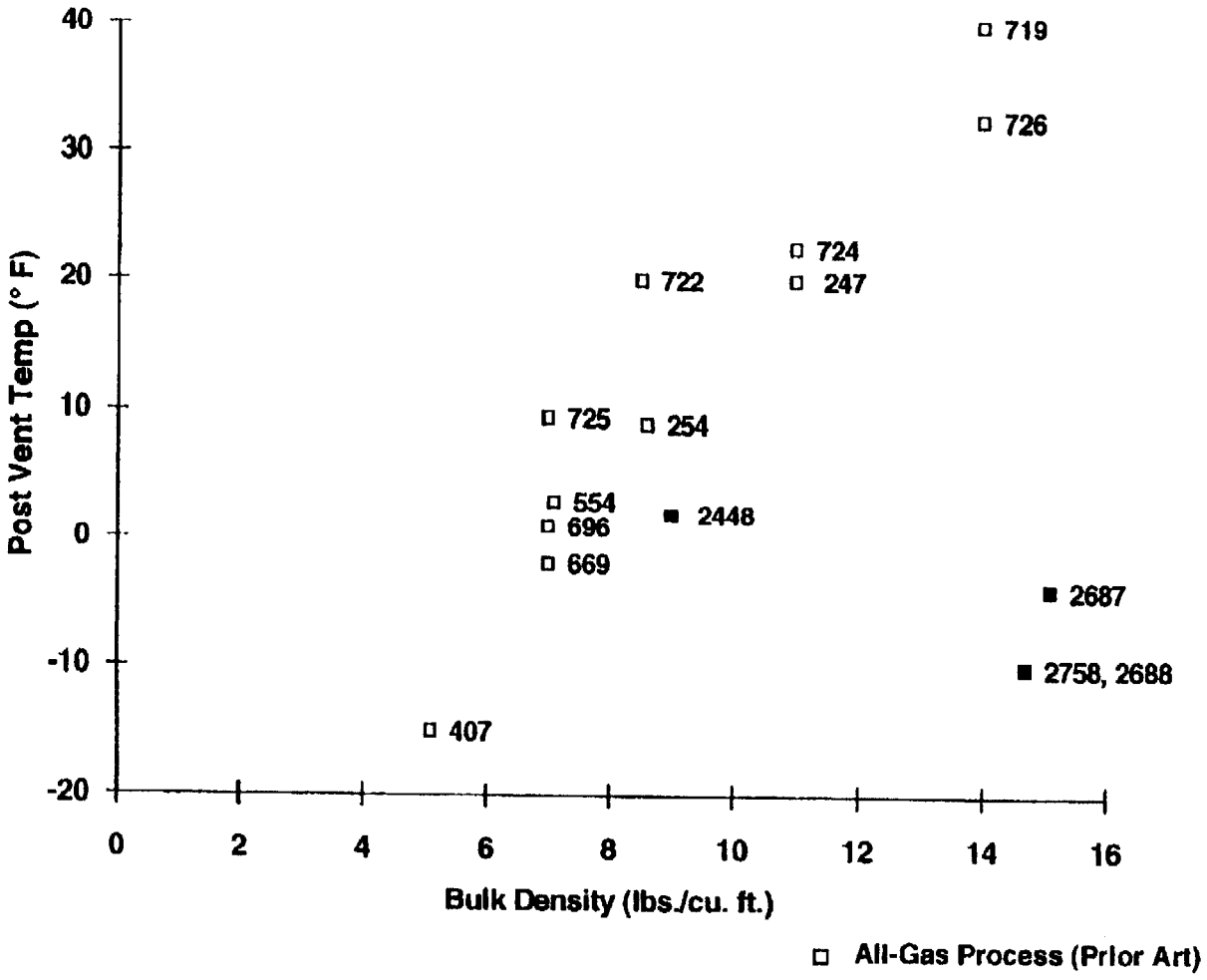
FIG. 20 is a plot of post-vent temperature versus bulk density showing temperature data for a process according to the invention and for an all gas impregnation process.

FIG. 20 shows the effect of tobacco bulk density on post-vent temperatures achieved by a prior all-gas impregnation process and by a process according to the invention. FIG. 20 is a representation of the data of Table 5 and Table 6 below. All of the tests were conducted using bright tobacco with an initial OV between 11 and 15.8% as listed in the table. Test number 407 was conducted using pre-expanded tobacco to achieve the low bulk density of 5.1 lbs./cu.ft. The all-gas process was conducted under typical conditions, for example as taught by U.S. Pat. No. 4,235,250 to Utsch.

As can be seen, the post-vent temperatures of the all-gas impregnation process generally increase as tobacco bulk density increases. At bulk densities of about 8.5 and about 11 lbs./cu.ft., the all-gas process resulted in a post-vent temperature of about 20° F. At 14 lbs./cu.ft., the all-gas process resulted in a post-vent temperature of about 33° F. to about 40° F. Temperatures below about 20° F. enhance stability of the impregnated tobacco.

In contrast, the process according to the invention achieves post-vent temperatures between about 0° F. and about −10° F. for bulk densities between about 9 and about 15 lbs./cu.ft. Therefore, the data demonstrates that the process of the invention achieves sufficient cooling and therewith post-impregnation stability regardless of bulk density, and particularly up to bulk densities of about 15.1 lbs./cu.ft.

TABLE 5

ALL-GAS PROCESS
EFFECT OF BULK DENSITY
ON POST-VENT TEMPERATURE

| Test No. | Bulk Density (lbs./cu. ft.) | Moisture (OV %) | Avg. Post Vent Temp. (°F.) |
|---|---|---|---|
| 407 | 5.1 | 11.0 | −15 |
| 554 | 7.1 | 15 | +3 |
| 669 | 7.0 | 14.1 | −2 |
| 696 | 7.0 | 14.8 | +1 |
| 725 | 7.0 | 15.0 | +10 |
| 254 | 8.6 | 12 | +9 |
| 722 | 8.5 | 15.0 | +20 |
| 247 | 11 | 15 | +20 |
| 724 | 11 | 15.0 | +23 |
| 719 | 14 | 15.0 | +40 |
| 726 | 14 | 15.0 | +33 |

TABLE 6

INVENTION PROCESS
EFFECT OF BULK DENSITY
ON POST-VENT TEMPERATURE

| Test No. | Bulk Density (lbs./cu. ft.) | Moisture (OV %) | Avg. Post Vent Temp. (°F.) |
|---|---|---|---|
| 2758 | 14.7 | 14.6 | −10 |
| 2687 | 15.1 | 15.7 | −4 |
| 2688 | 14.7 | 15.8 | −10 |
| 2448 | 9.0 | 14.4 | +2 |

TABLE 7

ALL-GAS PROCESS/EFFECT OF POST-VENT
TEMPERATURE ON $CO_2$ RETENTION

| Test | Bulk Density | Post-Vent Temperature | $CO_2$ Retention (% at time) | | |
|---|---|---|---|---|---|
| No. | (lbs./cu. ft.) | (°F.) | 2 min. | 10 min. | 20 min |
| 669 | 7 | −2 | 1.44 | 1.43 | |
| 725 | 7 | 9.5 | 1.28 | 0.75 | 0.46 |
| 724 | 11 | 22.6 | 1.00 | 0.54 | 0.28 |
| 726 | 14 | 32.6 | 0.45 | 0.36 | 0.20 |

FIG. 21 and associated Table 7 above show data for an all-gas process at different tobacco bulk densities. As discussed above, higher post-vent temperatures result for test runs at higher bulk densities. FIG. 21 demonstarates that higher post-vent temperatures correspond with lower initial carbon dioxide impregnation, and more rapid loss of carbon dioxide over time.

The term "cylinder volume" is a unit for measuring the degree of expansion of tobacco. As used throughout this application, the values employed, in connection with these terms are determined as follows:

Cylinder Volume (CV)

Tobacco filler weighing 20 grams, if unexpanded, or 10 grams, if expanded, is placed in a 6-cm diameter Densimeter cylinder, Model No. DD-60, designed by the Heinr. Borgwaldt Company, Heinr. Borgwaldt GmbH, Schnackenburgallee No. 15, Postfach 54 07 02, 2000 Hamburg 54 West Germany. A 2 kg piston, 5.6 cm in diameter, is placed on the tobacco in the cylinder for 30 seconds. The resulting volume of the compressed tobacco is read and divided by the tobacco sample weight to yield the cylinder volume as cc/gram. The test determines the apparent volume of a given weight of tobacco filler. The resulting volume of filler is reported as cylinder volume. This test is carried out at standard environmental conditions of 75° F. and 60% RH; conventionally, unless otherwise stated, the sample is preconditioned in this environment for 24–48 hours.

Specific Volume (SV)

The term "specific volume" is a unit for measuring the volume and true density of solid objects, e.g., tobacco, using the fundamental principles of the ideal gas law. The specific volume is determined by taking the inverse of the density and is expressed as "cc/g". A weighed sample of tobacco, either "as is", dried at 100° C. for 3 hours, or equilibrated, is placed in a cell in a Quantachrome Penta-Pycnometer. The cell is then purged and pressured with helium. The volume of helium displaced by the tobacco is compared with the volume of helium required to fill an empty sample cell and the tobacco volume is determined based on Archimedes' principle. As used throughout this application, unless stated to the contrary, specific volume was determined using the same tobacco sample used to determine OV, i.e., tobacco dried after exposure for 3 hours in a circulating air oven controlled at 100° C.

While the invention has been particularly shown and described with reference to preferred embodiments, it will be understood by those skilled in the art that various changes in form and details may be made without departing from the spirit and scope of the invention. For example, as size of the equipment used to impregnate the tobacco varies the time required to reach the desired pressure, or to vent, or to adequately cool the tobacco bed will vary.

We claim:

1. An impregnation vessel comprising:

a tobacco receiving chamber having a first end portion and a second end portion;

a first gas distributor assembly movable between a first position adjacent said first end portion of said chamber and a second position removed from said chamber, said first gas distributor assembly arranged to load a charge of tobacco into said chamber upon movement of said first gas distributor assembly from said second position to said first position, said first gas distributor assembly arranged to distribute the expansion agent about said first end portion of said chamber when said first gas distributor assembly is at said first position;

a second gas distributor assembly adjacent said second end portion of said chamber;

a gas inlet arranged to introduce the expansion agent into said impregnation vessel through said first gas distributor assembly when said first gas distributor assembly is at said first position; and a gas outlet arranged to release the expansion agent from about said second end portion of said chamber through said second gas distributor assembly.

2. The impregnation vessel as claimed in 1, wherein said second gas distributor assembly is movable from a first location adjacent said second end portion of said chamber in a direction toward said first end portion of said chamber, said second gas distributor assembly arranged to unload a charge of tobacco from said chamber upon movement toward said first end portion of said chamber.

3. The impregnation vessel as claimed in claim 2, wherein said first gas distributor assembly comprises a gas distribution plate and a first plenum adjacent said gas distribution plate.

4. The impregnation vessel as claimed in claim 3, wherein said second gas distributor assembly comprises a second distribution plate and a second plenum adjacent said second distribution plate.

5. The impregnation vessel as claimed in claim 4, wherein said impregnation vessel includes a first piston adjacent said first end portion of said chamber and said first gas distributor assembly is movable with said first piston.

6. The impregnation vessel as claimed in claim 5, wherein said impregnation vessel includes a second piston adjacent said second end portion of said chamber and said second gas distributor assembly is movable along said chamber with said second piston.

7. The system as claimed in claim 6, further comprising a tobacco compactor and a tobacco carrier arranged to transport tobacco from the compactor to the impregnation vessel, the tobacco carrier comprising a plurality of tobacco containers and a conveyor arranged to move said containers from the compactor to the impregnation vessel.

8. The system as claimed in claim 7, wherein said containers each include a removable sleeve, said first piston adapted to move said sleeve from said container into said chamber as said first gas distributor assembly moves from said second position to said first position, said second piston adapted to return said sleeve to said container.

9. The system as claimed in claim 8, further comprising means for discharging tobacco from said system, a feeder adapted to feed a predetermined amount of loose tobacco into said containers and conveyor is arranged to cyclically move containers into operative positions with said feeder, said compactor, said impregnation vessel and said discharging means, said system arranged so that loose tobacco is fed into each container by said feeder, is subsequently compacted at said compactor, then subsequently impregnated with an expansion agent at said impregnation vessel and then discharged by said discharging means from said system, whereupon said container is returned to said feeder by said conveyor.

10. The system of claim 9 wherein said containers are cylindrical and said conveyor comprises a turntable.

11. The system of claim 10 wherein said system is further arranged to discharge to a tobacco expansion device.

12. The system of claim 11 wherein each container is a cylinder having open ends.

13. The system of claim 12, wherein said feeder and said compactor are operative at the same location.

14. The impregnation vessel as claimed in claim 2, wherein said impregnation vessel includes an insulating liner along said tobacco receiving chamber.

15. The impregnation vessel as claimed in claim 6 further comprising a first seal operative between an upper portion of said first piston and a first location along said first end portion of said chamber, and a second seal operative between said first gas distributor assembly and a second location along said first end portion of said chamber.

16. The impregnation vessel as claimed in claim 15, wherein a gas inlet to said first gas plenum is at a location along said first end portion of said chamber between said first and second locations.

17. The impregnation vessel as claimed in claim 16, further comprising a third seal operative between said second gas distributor assembly and said second end portion of said vessel.

18. The impregnation vessel as claimed in claim 17, further comprising a fourth seal operative between a shaft portion of said second piston and an adjacent portion of said second end portion of said vessel.

19. The impregnation vessel as claimed in claim 17, further comprising a sleeve removably disposed within said chamber between said first and second gas distributor assemblies, said sleeve adapted to contain said charge of tobacco.

20. The impregnation vessel as claimed in claim 19, wherein said sleeve includes a perforation.

21. A system for impregnating tobacco with a gaseous expansion agent, said system comprising:

an impregnation vessel comprising:

a tobacco receiving chamber having a first end portion and a second end portion;

a first gas distributor assembly movable between a first position adjacent said first end portion of said chamber and a second position removed from said chamber, said first gas distributor assembly arranged to load a charge of tobacco into said chamber upon movement of said first gas distributor assembly from said second position to said first position, said first gas distributor assembly arranged to distribute the expansion agent about said first end portion of said chamber when said first gas distributor assembly is at said first position;

a second gas distributor assembly adjacent said second end portion of said chamber;

a gas inlet arranged to introduce the expansion agent into said impregnation vessel through said first gas distributor assembly when said first gas distributor assembly is at said first position; and a gas outlet arranged to release the expansion agent from about said second end portion of said chamber through said second gas distributor assembly;

said system further comprising a tobacco compactor and a tobacco carrier arranged to transport tobacco from the compactor to the impregnation vessel, the tobacco carrier comprising a plurality of tobacco containers and a conveyor arranged to move said containers from the compactor to the impregnation vessel.

22. The system as claimed in claim 21, wherein said containers each include a removable sleeve, said first gas distributor assembly adapted to move said sleeve from said container into said chamber while moving from said second position to said first position.

* * * * *